US010801187B2

(12) United States Patent
Izumi et al.

(10) Patent No.: US 10,801,187 B2
(45) Date of Patent: Oct. 13, 2020

(54) WORK MACHINE

(71) Applicant: HITACHI CONSTRUCTION MACHINERY CO., LTD., Tokyo (JP)

(72) Inventors: Shiho Izumi, Hitachinaka (JP); Ryuu Narikawa, Mito (JP); Kouji Ishikawa, Kasumigaura (JP); Daito Sakai, Tsuchiura (JP); Takahiko Kurose, Moriya (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 65 days.

(21) Appl. No.: 16/090,605

(22) PCT Filed: Feb. 28, 2017

(86) PCT No.: PCT/JP2017/007986
§ 371 (c)(1),
(2) Date: Oct. 2, 2018

(87) PCT Pub. No.: WO2018/003176
PCT Pub. Date: Jan. 4, 2018

(65) Prior Publication Data

US 2019/0119886 A1 Apr. 25, 2019

(30) Foreign Application Priority Data

Jun. 30, 2016 (JP) ..... 2016-129984

(51) Int. Cl.
*E02F 9/26* (2006.01)
*E02F 3/43* (2006.01)
(Continued)

(52) U.S. Cl.
CPC ..... *E02F 9/265* (2013.01); *E02F 3/43* (2013.01); *E02F 3/435* (2013.01); *E02F 9/20* (2013.01);
(Continued)

(58) Field of Classification Search
CPC ..... E02F 9/265; E02F 9/2033; E02F 9/2004; E02F 9/2271; E02F 9/26; E02F 3/43; E02F 3/435; E02F 3/32
See application file for complete search history.

(56) References Cited

U.S. PATENT DOCUMENTS

2016/0010312 A1* 1/2016 Kurihara ..... E02F 3/435 701/36
2016/0244950 A1 8/2016 Kami et al.
2016/0251835 A1 9/2016 Kitajima et al.

FOREIGN PATENT DOCUMENTS

JP 2013-217137 A 10/2013
JP 2016-003442 A 1/2016
(Continued)

OTHER PUBLICATIONS

International Preliminary Report on Patentability received in corresponding International Application No. PCT/JP2017/007986 dated Jan. 10, 2019.
(Continued)

*Primary Examiner* — Imran K Mustafa
(74) *Attorney, Agent, or Firm* — Mattingly & Malur, PC

(57) ABSTRACT

Provided is a work machine that is equipped with a control unit that executes area limiting control with respect to a work device. The control unit includes: a position computing section that calculates the position, on an operation plane, of the forward end (first reference point) of a bucket and the rear end (second reference point) of the bucket; and a first distance computing section that calculates the distances in the operating plane from the first reference point and the second reference point to the target face A to be controlled. When the smaller one of the two distances is equal to or lower than a threshold during area limiting control, the control unit corrects an operation signal output from an operation lever device so as to reduce the operating speed of
(Continued)

a hydraulic actuator that is a control target of the operation signal.

3 Claims, 17 Drawing Sheets

(51) Int. Cl.
*E02F 9/20* (2006.01)
*E02F 9/22* (2006.01)
*E02F 3/32* (2006.01)

(52) U.S. Cl.
CPC ..... *E02F 9/2004* (2013.01); *E02F 9/2033* (2013.01); *E02F 9/2271* (2013.01); *E02F 9/26* (2013.01); *E02F 3/32* (2013.01)

(56) References Cited

FOREIGN PATENT DOCUMENTS

WO 2015/181989 A1 12/2015
WO 2015/186180 A1 12/2015

OTHER PUBLICATIONS

International Search Report of PCT/JP2017/007986 dated May 30, 2017.
Extended European Search Report received in corresponding European Application No. 17819546.7 dated Feb. 14, 2020.

* cited by examiner

WORK MACHINE

TECHNICAL FIELD

The present invention relates to a work machine.

BACKGROUND ART

In a hydraulic excavator, work members such as a boom, an arm, and a bucket (hereinafter also referred to as the "front work device") are each rotatably supported, so that, when operated singly, the forward end of the bucket crowds an arcuate locus. Thus, in the case where a linear finished surface is to be formed with the forward end of the bucket, for example, through arm crowding operation, it is necessary for the operator to drive the boom, the arm and the bucket in a combined fashion to make the locus of the bucket forward end linear. Thus, high skill is required of the operator.

In view of this, a technique is available according to which a function by which the driving of actuator is controlled automatically or semi-automatically by a computer (controller) (the function is referred to as a machine control) is applied to excavation works, with the forward end of the bucket being moved along a target surface at the time of excavating operation (at the time of operation of the arm or the bucket). As a technique of this type, there is known one according to which a boom cylinder is automatically controlled during excavating operation through control by the operator to add the boom raising operation as appropriate, limiting the bucket forward end position to the target surface.

A configuration of a target surface is not always set as a single flat surface, and there are cases where a plurality of target surfaces are set continuously. Disclosed in Patent Document 1 is a technique according to which when a target configuration of the excavation work is defined by at least one segment defined by two points, an operation signal is corrected such that the operation of at least one of the plurality of hydraulic actuators is reduced when the distal end of the work device approaches one of a plurality of points determining the at least one segment.

PRIOR ART DOCUMENT

Patent Document

Patent Document 1: JP-2016-3442-A

SUMMARY OF THE INVENTION

Problem to be Solved by the Invention

In Patent Document 1, a control object of the work device is the distal end of the work device. The work device is decelerated in accordance with the distance between one of the points defining the target surface (segment) and the distal end of the work device.

Depending on the posture of the bucket constituting the distal end of the work device, however, there are cases where not the forward end (claw tip) of the bucket but some other point on the bucket (e.g., the rear end of the bucket which is the point on the opposite side of the bucket forward end at a bucket bottom surface portion) is closest to the target surface. In such cases, proper control is impossible with the technique of Patent Document 1, and there is a possibility of the other point (e.g., the rear end of the bucket) intruding the target surface.

It is an object of the present invention to provide a work machine performing proper deceleration control on the work device in the case where there are a plurality of target surfaces.

Means for Solving the Problem

The present application includes a plurality of means for solving the above problem, an example of which is a work machine including: a multi-joint type work device formed by connecting a plurality of driven members and configured to operate in a predetermined operational plane; a plurality of hydraulic actuators each driving corresponding one of the plurality of driven members on the basis of an operation signal; an operation device outputting the operation signal to a hydraulic actuator desired by an operator among the plurality of hydraulic actuators; and a controller that executes area limiting control such that the work device moves on a target surface of a control object and in an area above the target surface, by outputting the operation signal to at least one of the plurality of actuators or by correcting the operation signal output to at least one of the plurality of hydraulic actuators. The controller is equipped with a storage device storing two segments that are connected at a different angle in the operational plane and that can be the target surface of the control object, a position of an inflection point that is an intersection of the two segments in the operational plane, and a first reference point and a second reference point set at a distal end portion of the work device, a position computing section computing positions of the first reference point and the second reference point in the operational plane on the basis of a posture of the work device, and a first distance computing section computing distances from the first reference point and the second reference point in the operational plane to the target surface of the control object; and when a smaller one of the distances from the first reference point and the second reference point to the target surface of the control object is equal to or lower than a threshold value, the controller corrects the operation signal output from the operation device so as to reduce an operational speed of the hydraulic actuator that is an control target of the operation signal.

Effect of the Invention

According to the present invention, even when there exist a plurality of target surfaces, proper deceleration control is executed, and it is possible to prevent intrusion of the work device on the target surfaces.

MODES FOR CARRYING OUT THE INVENTION

In the following, an embodiment of the present invention will be described with reference to the drawings. While in the following the present invention is applied to a hydraulic excavator equipped with a bucket 1*c* as the attachment at the distal end of a work device, the present invention may also be applied to a hydraulic excavator equipped with an attachment other than a bucket. Further, the present invention is also applicable to a work machine other than a hydraulic excavator so long as it has a multi-joint type work device formed by connecting together a plurality of driven members and configured to operate in a predetermined operational plane.

In the following description, when there exist a plurality of same components, a letter may be affixed to the end of the character (number). In some cases, however, the letter may be omitted, and the plurality of components may be given collectively. For example, when there exist three pumps 300*a*, 300*b*, and 300*c*, these may be collectively written as pumps 300.

Figure 1:
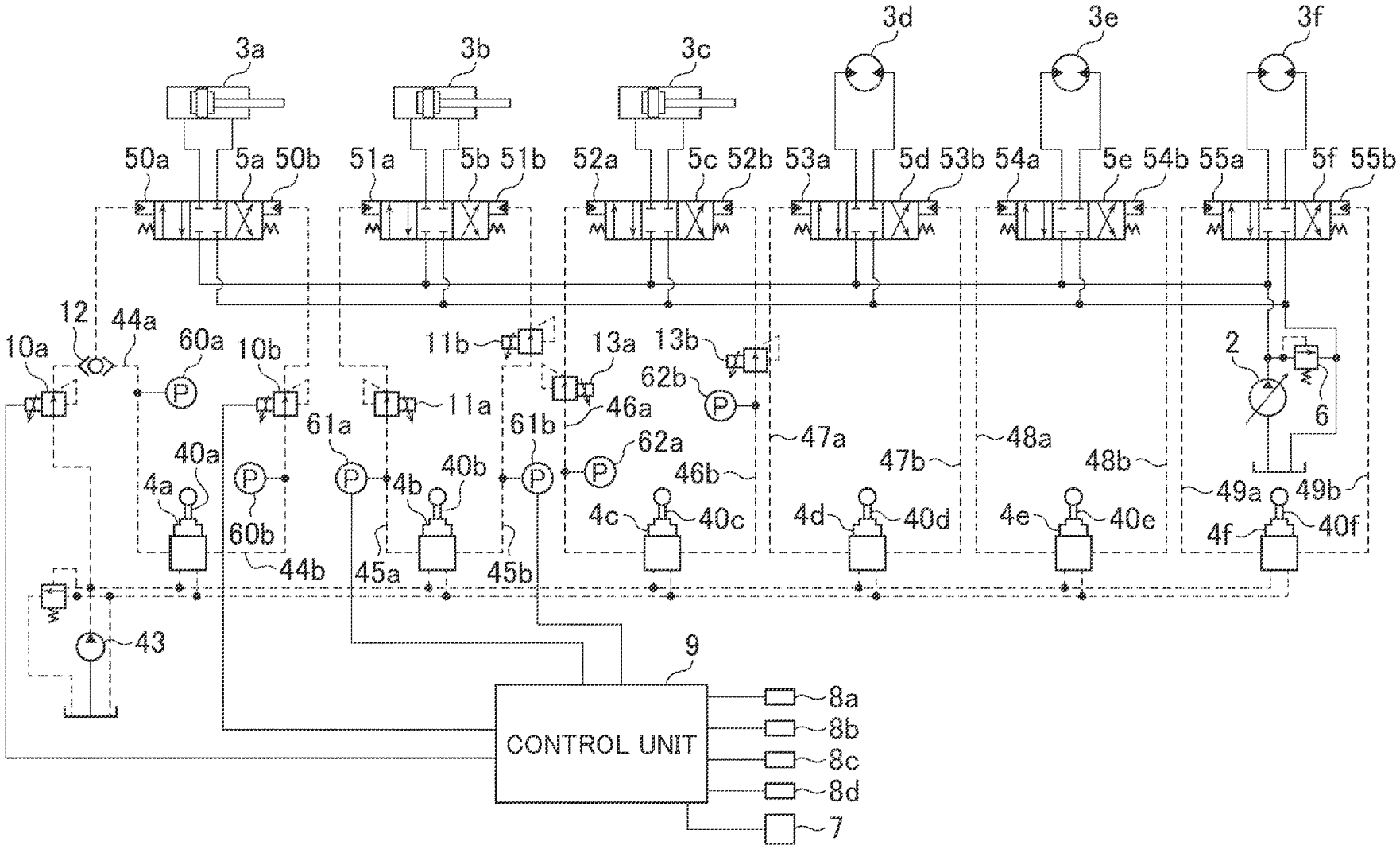
FIG. 1 is a diagram illustrating an excavation control system of a hydraulic excavator according to an embodiment of the present invention along with a hydraulic drive system thereof.

In FIG. 1, the hydraulic excavator to which the present invention is applied has: a hydraulic pump 2; a plurality of hydraulic actuators including a boom cylinder 3*a*, an arm cylinder 3*b*, a bucket cylinder 3*c*, a swing motor 3*d*, and left and right traveling motors 3*e* and 3*f* which are driven by a hydraulic working fluid from the hydraulic pump 2; a plurality of operation lever devices (operation devices) 4*a* through 4*f* provided respectively in correspondence with the hydraulic actuators 3*a* through 3*f*; a plurality of flow control valves 5*a* through 5*f* connected between the hydraulic pump 2 and the plurality of hydraulic actuators 3*a* through 3*f*, controlled by an operation signal output in accordance with the operation amount and the operating direction of the operation lever devices 4*a* through 4*f*, and controlling the flow rate and the direction of the hydraulic working fluid supplied to the actuators 3*a* through 3*f*; and a relief valve 6 configured to be opened when the pressure between the hydraulic pump 2 and the flow control valves 5*a* through 5*f* is equal to or more than a set value. These constitute a hydraulic drive system driving the driven members of the hydraulic excavator.

Figure 2:
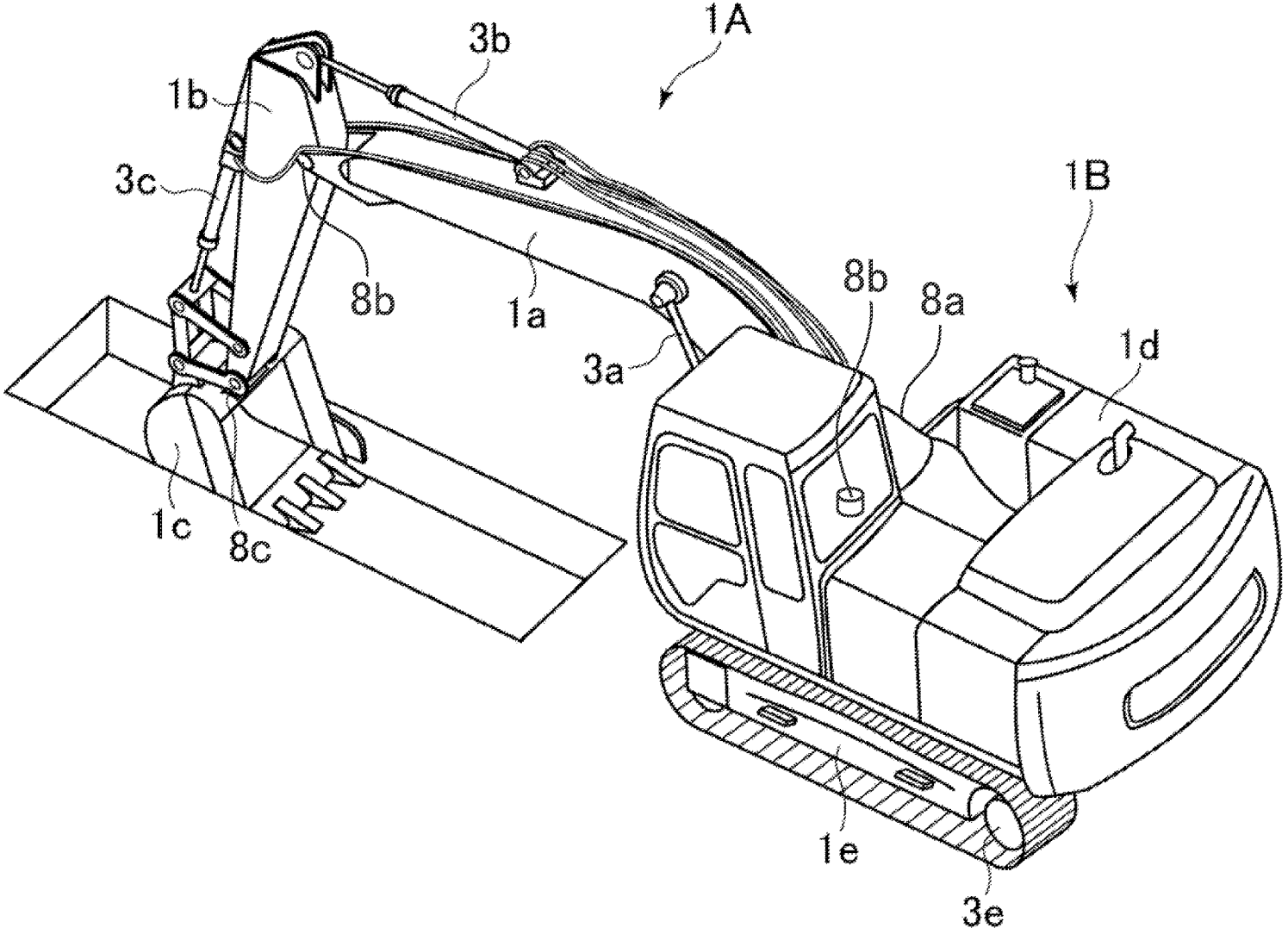
FIG. 2 is an outward view of a hydraulic excavator to which the present invention is applied.

As shown in FIG. 2, the hydraulic excavator is composed of a multi-joint type front work device 1A formed by connecting a plurality of vertically rotating driven members (a boom 1*a*, an arm 1*b*, and a bucket 1*c*), and a machine body 1B consisting of an upper swing structure 1*d* and a lower track structure 1*e*, and the proximal end of the boom 1*a* of the front work device 1A is supported by the front portion of the upper swing structure 1*d*. The boom 1*a*, the arm 1*b*, the bucket 1*c*, the upper swing structure 1*d*, and the lower track structure 1*e* constitute the driven members respectively driven by a boom cylinder 3*a*, an arm cylinder 3*b*, a bucket cylinder 3*c*, a swing motor 3*d*, and left and right traveling motors 3*e* and 3*f*.

The boom 1*a*, the arm 1*b*, and the bucket 1*c* operate in a plane orthogonal to the front work device 1A in the width direction. In the following, this plane may be referred to as the operational plane. The operational plane is a plane orthogonal to the rotation shafts of the boom 1*a*, the arm 1*b*, and the bucket 1*c*, and can be set at the center in the width direction of the boom 1*a*, the arm 1*b*, and the bucket 1*c*.

The operations of the boom cylinder 3*a*, the arm cylinder 3*b*, the bucket cylinder 3*c*, the swing motor 3*d*, and the left and right traveling motors 3*e* and 3*f* are designated by operation signals (pilot pressures) input to hydraulic drive sections 50*a* through 55*b* of the flow control valves 5*a* through 5*f* controlling the direction and the flow rate of the hydraulic working fluid supplied to the actuators 3*a*, 3*b*, 3*c*, 3*d*, 3*e*, and 3*f*. Some operation signals are output via operation lever devices 4*a* through 4*f*, and other operation signals are output from a pilot pump 43 via a solenoid proportional valve 10*a*.

The operation lever devices 4*a* through 4*f* are of the hydraulic pilot type. They supply as operation signals pilot pressures in correspondence with the operation amounts of the operation levers 4*a* through 4*f* respectively operated by the operator to the hydraulic drive sections 50*a* through 55*b* of the flow control valves 5*a* through 5*f* corresponding to the operational direction via pilot lines 44*a* through 49*b*, and drive these flow control valves.

The hydraulic excavator of the present embodiment is equipped with a control system aiding the excavating operation of the operator. More specifically, there is provided an excavation control system that executes control in which, when excavating operation (more specifically, designation of arm crowding, bucket crowding, or bucket dumping) is input via the operation lever devices 4*b* and 4*c*, based on the positional relationship between a control point set at the distal end portion of the work device 1A and a target surface, the position of the control point is maintained in an area on or above the target surface, with at least one of the hydraulic actuators 3*a*, 3*b*, and 3*c* being forcibly operated such that it does not intrude the area under the target surface (with, for example, the boom cylinder 3*a* being extended to forcibly perform the boom raising operation). In this specification, this control is sometimes referred to as "area limiting control" or "machine control." Due to this control, intrusion of the control point into the area below the target surface is prevented, so that it is possible to perform excavation along the target surface independently of the degree of skill of the operator.

Figure 7:
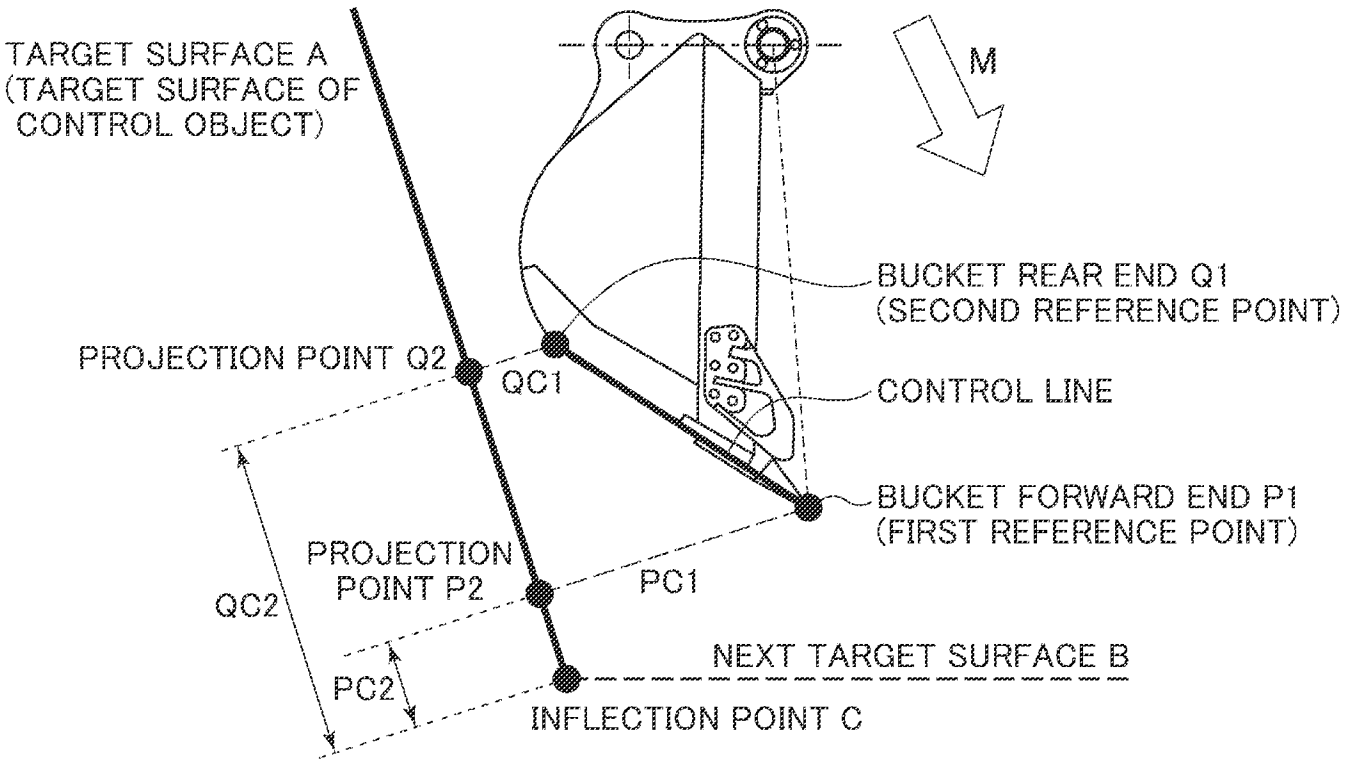
FIG. 7 is a diagram illustrating an example of the positional relationship between a bucket and an inflection point.

In the present embodiment, as shown in FIG. 7, the control point related to the area limiting control is set on a segment connecting the forward end P1 and the rear end Q1 of the bucket 1*c* (the segment is referred to as the "control line"). Further, in the present embodiment, the control point is set on the control line. In the case where the control line is above the target surface, the point on the control line that is closest to the target surface is used as the control point, and in the case where the control line crosses the target surface or below the target surface, the point on the control line that is most intruding on the target surface is used as the control point. Thus, in the example of FIG. 7, the bucket rear end Q1 serves as the control point. Regarding the control line it is also possible to select a segment other than that shown in FIG. 7 as the control line so long as it is included in the contour of the sectional configuration of the distal end portion of the work device 1A (e.g., the bucket 1*c*) taken along the operational plane. Further, there are no limitations to the rule by which the control point is set on the control line. For example, it may be selectable arbitrary by the operator from the control line.

The excavation control system used for area limiting control is equipped with: an area limiting switch 7 installed at a position where it does not interfere with the field of vision of the operator, for example, above the operation panel in the cab, and configured to switch between effective and ineffective of the area limiting control; a storage device (e.g., ROM) 93 storing various items of information such as information on the target configuration of the excavation object set continuously by a plurality of target surfaces (segments) (target configuration information), and the area where the control point of the work device 1A is to operate for the purpose of forming the target configuration (which is also referred to as the "set area"); angle sensors 8*a*, 8*b*, and 8*c* provided at the respective rotational fulcrums of the boom 1*a*, the arm 1*b*, and the bucket 1*c* and detecting their rotational angles as condition amounts related to the position and posture of the front work device 1A; and an inclination angle sensor 8*d* detecting the inclination angle in the front-rear direction of the machine body 1B with respect to a reference surface (e.g., a horizontal surface).

The excavation control system according to the present embodiment is equipped with: pressure sensors 60*a* and 60*b* provided in pilot lines 44*a* and 44*b* of the operation lever device 4*a* for the boom 1*a* and detecting a pilot pressure (operation signal) as the operation amount of the operation lever device 4*a*; pressure sensors 61*a* and 61*b* provided in pilot lines 45*a* and 45*b* of the operation lever device 4*b* for the arm 1*b* and detecting a pilot pressure (operation signal) as the operation amount of the operation lever device 4*b*; and pressure sensors 62*a* and 62*b* provided in pilot lines 46*a* and 46*b* of the operation lever device 4*c* for the bucket 1*c* and detecting a pilot pressure (operation signal) as the operation amount of the operation lever device 4*c*.

Further, the excavation control system according to the present embodiment is equipped with: a solenoid proportional valve 10*a* a primary port side of which is connected to a pilot pump 43 and which reduces and outputs the pilot pressure from the pilot pump 43 in accordance with an electric signal; a shuttle valve 12 connected to a pilot line 44*a* of the operation lever device 4*a* for the boom 1*a* and to a secondary port side of the solenoid proportional valve 10*a*, selecting the higher of the pilot pressure in the pilot line 44*a* and the control pressure output from the solenoid proportional valve 10*a*, and guiding it to a hydraulic drive section 50*a* of the flow control valve 5*a*; a solenoid proportional valve 10*b* installed in a pilot line 44*b* of the operation lever device 4*a* for the boom 1*a* and reducing and outputting the pilot pressure in the pilot line 44*b* in accordance with an electric signal; a solenoid proportional valve 11*a* installed in a pilot line 45*a* of the operation lever device 4*b* for the arm 1*b* and reducing and outputting the pilot pressure in the pilot line 45*a* in accordance with an electric signal; a solenoid proportional valve 11*b* installed in a pilot line 45*b* of the operation lever device 4*b* for the arm 1*b* and reducing and outputting the pilot pressure in the pilot line 45*b* in accordance with an electric signal; a solenoid proportional valve 13*a* installed in a pilot line 46*a* of the operation lever device 4*c* for the bucket 1*c* and reducing and outputting the pilot pressure in the pilot line 46*a* in accordance with an electric signal, and a solenoid proportional valve 13*b* installed in a pilot line 46*b* of the operation lever device for the bucket 1*c* and reducing and outputting the pilot pressure in the pilot line 46*b* in accordance with an electric signal.

Furthermore, the excavation control system according to the present embodiment is equipped with a control unit (controller) 9 that is a computer inputting therein the target configuration information stored in the storage device 93, the detection signals of the angle sensors 8*a*, 8*b*, and 8*c* and of the inclination angle sensor 8*d*, and the detection signals of pressure sensors 60*a*, 60*b*, 61*a*, 61*b*, 62*a*, and 62*b*, setting a set area that is an area on a plurality of target surfaces defining the target configuration and above the same, and outputting an electric signal performing correction on an operation signal (pilot pressure) to conduct excavation control (area limiting control) limiting the operational range of the control point of the work device distal end portion to the set area to the solenoid proportional valves 10*a*, 10*b*, 11*a*, 11*b*, 13*a*, and 13*b*.

The solenoid proportional valve 10*a* and the shuttle valve 12 generating pilot pressure also in the case where there is no operation of the operation lever device 4*a* are installed solely in the pilot line 44*a*. It is also possible, however, to install them in the other pilot lines 44*b*, 45, and 46 related to the boom cylinder 3*a*, the arm cylinder 3*b* and the bucket cylinder 3*c* to generate pilot pressure. Further, a solenoid proportional valve similar to the solenoid proportional valve 10*b* of the pilot line 44*b*, i.e., a solenoid proportional valve reducing the pilot pressure output from the operation lever device 4*a*, may also be installed in the pilot line 44*a*.

Figure 6:
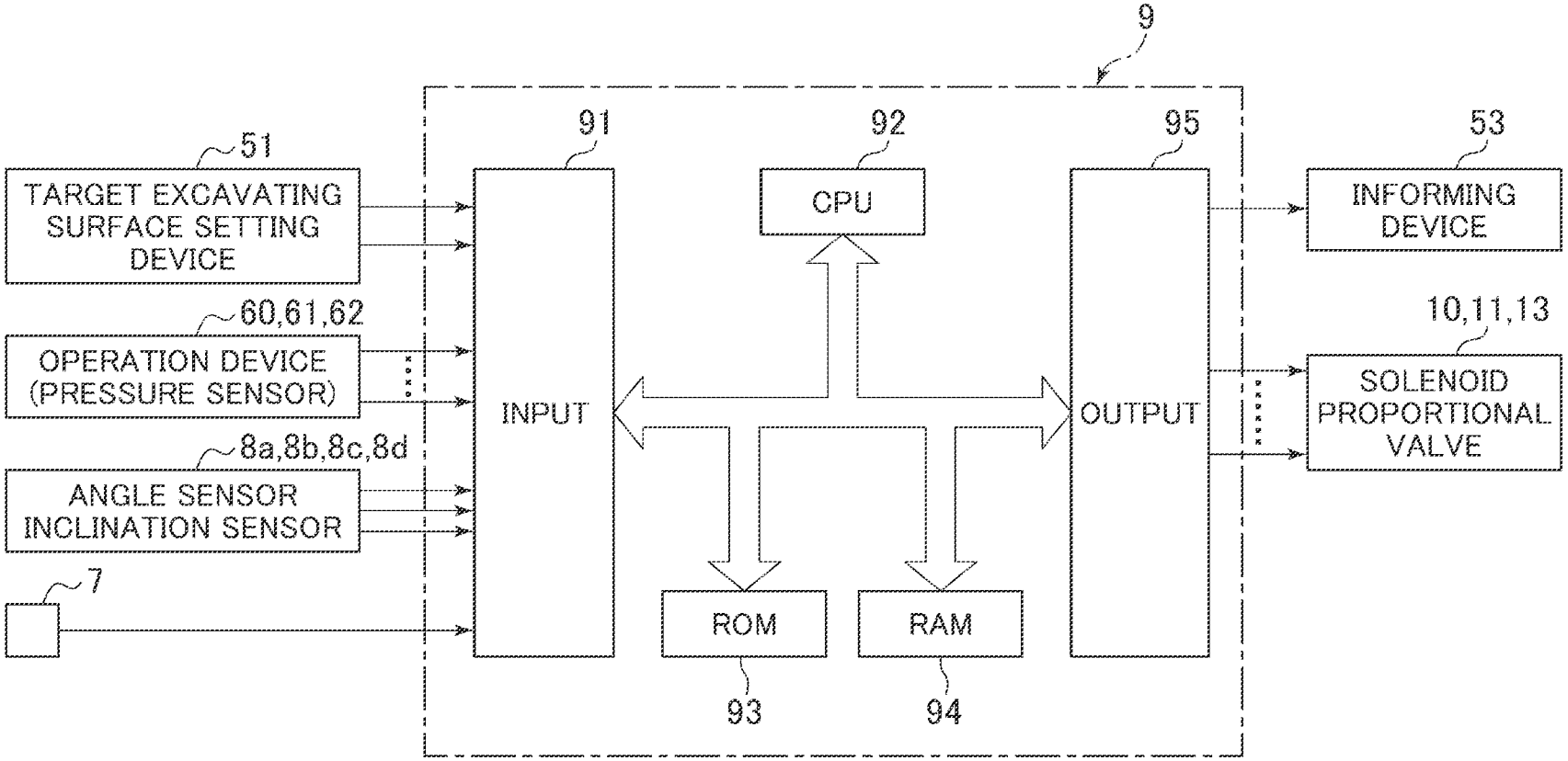
FIG. 6 is a diagram illustrating the hardware structure of the control unit.

FIG. 6 shows the hardware structure of the control unit 9. The control unit 9 has an input section 91, a central processing unit (CPU) 92 which is a processor, a read-only memory (ROM) 93 and a random-access memory (RAM) 94 which are storage devices, and an output section 95. The input section 91 inputs signals from pressure sensors 60, 61, and 62 detecting pressure generated through the operation of the operation lever device 4, a signal from a setting device 51 for setting the target surface, and signals from the angle sensors 8*a* through 8*c* and the inclination angle sensor 8*d* to perform A/D conversion. The ROM 93 is a storage medium storing a control program for executing a flowchart described below, various items of information necessary for the execution of the flowchart, and the CPU 92 performs predetermined computation processing with respect to the signals taken in from the input section 91 and the memories 93 and 94 in accordance with the control program stored in the ROM 93. The output section 95 prepares an output signal in accordance with the computation result at the CPU 92, and outputs the signal to the solenoid proportional valves 10, 11, and 13 and an informing device 53, whereby the hydraulic actuators 3*a*, 3*b*, and 3*c* are driven/controlled, and images of the machine body 1B, the bucket 1*c*, the target surface, and the like are displayed on the display screen of a monitor which is the informing device 53. While the control unit 9 of FIG. 6 is equipped with the semiconductor memories, i.e., the ROM 93 and the RAM 94, as the storage devices, they may be replaced so long as they are storage devices. For example, a magnetic storage device such as a hard disk drive may be provided.

Figure 3:
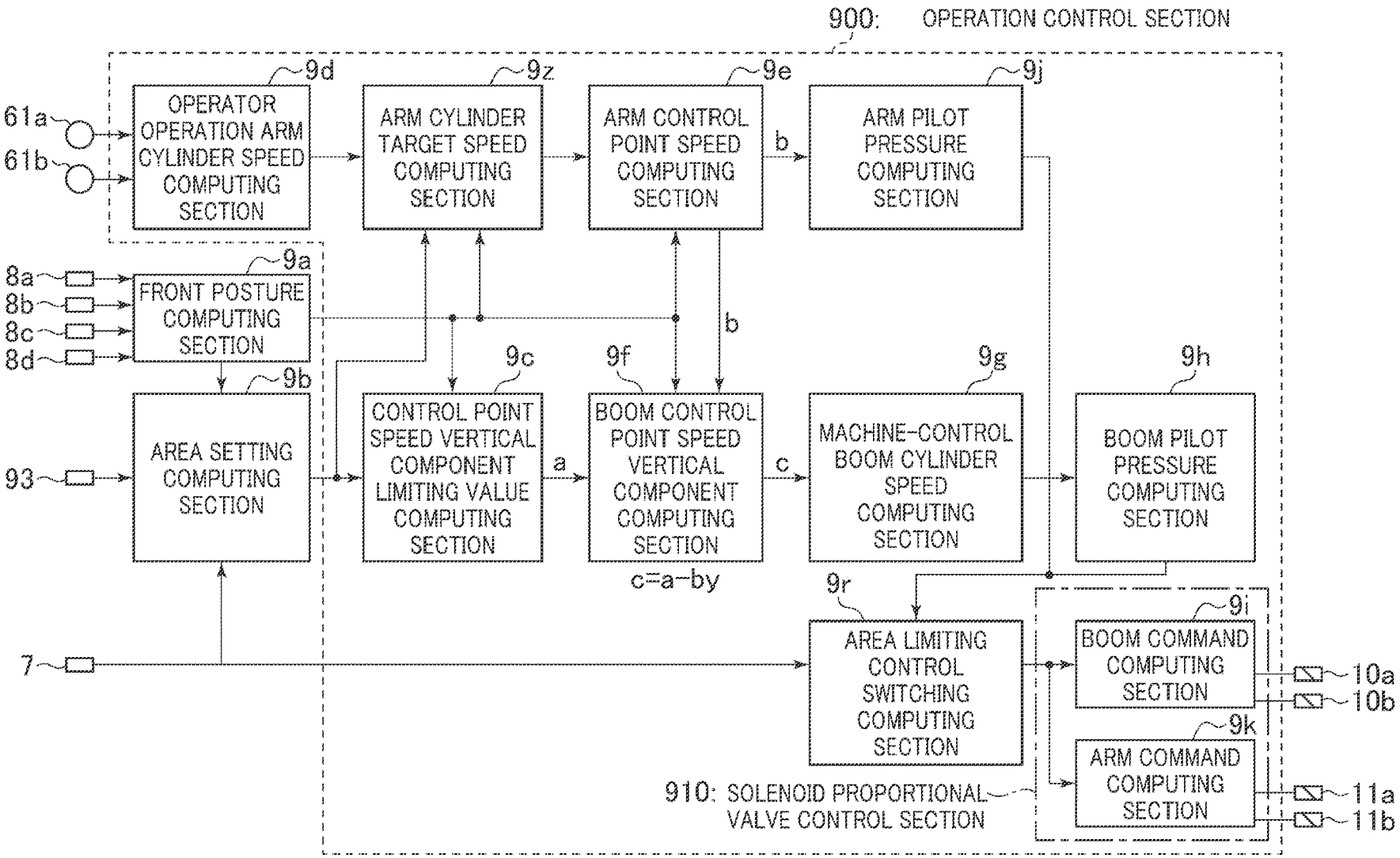
FIG. 3 is a functional block diagram illustrating the control functions of a control unit.

FIG. 3 shows the control function of the control unit 9. The control unit 9 has the following functions: a front posture computing section 9*a*, an area setting computing section 9*b*, a control point speed vertical component limiting value computing section 9*c*, an operator operation arm cylinder speed computing section 9*d*, an arm control point speed computing section 9*e*, a boom control point speed vertical component computing section 9*f*, a machine-control boom cylinder speed computing section 9*g*, a boom pilot pressure computing section 9*h*, an area limiting control switching computing section 9*r*, a boom command computing section 9*i*, an arm pilot pressure computing section 9*j*, an arm command computing section 9*k*, and an arm cylinder target speed computing section 9*z*.

In the present specification, the functions 9*c*, 9*d*, 9*e*, 9*f*, 9*g*, 9*h*, 9*j*, 9*r*, and 9*z* surrounded by a dotted line in FIG. 3 may be referred to as the "operation control section 900." In the operation control section 900, the boom command computing section 9*i* and the arm command computing section 9*k* surrounded by a chain-dotted line may be referred to as the "solenoid proportional valve control section 910."

The front posture computing section 9*a* computes the position and posture of the front work device 1A based on the rotational angle of the boom 1*a*, the arm 1*b*, and the bucket 1*c* and the inclination angle in the front-rear direction of the machine body 1B detected by the angle sensors 8*a* through 8*c* and the inclination angle sensor 8*d*. An example thereof will be described with reference to FIG. 4. In the case of this example, the position of the claw tip (forward end) P1 of the bucket 1*c* of the front work device 1A is computed. Through the computation of the position and posture of the front work device 1A, the position and posture of the control line is also computed. Here, for the simplification of the description, the detection value of the inclination angle sensor 8*d* is not taken into consideration.

Figure 4:
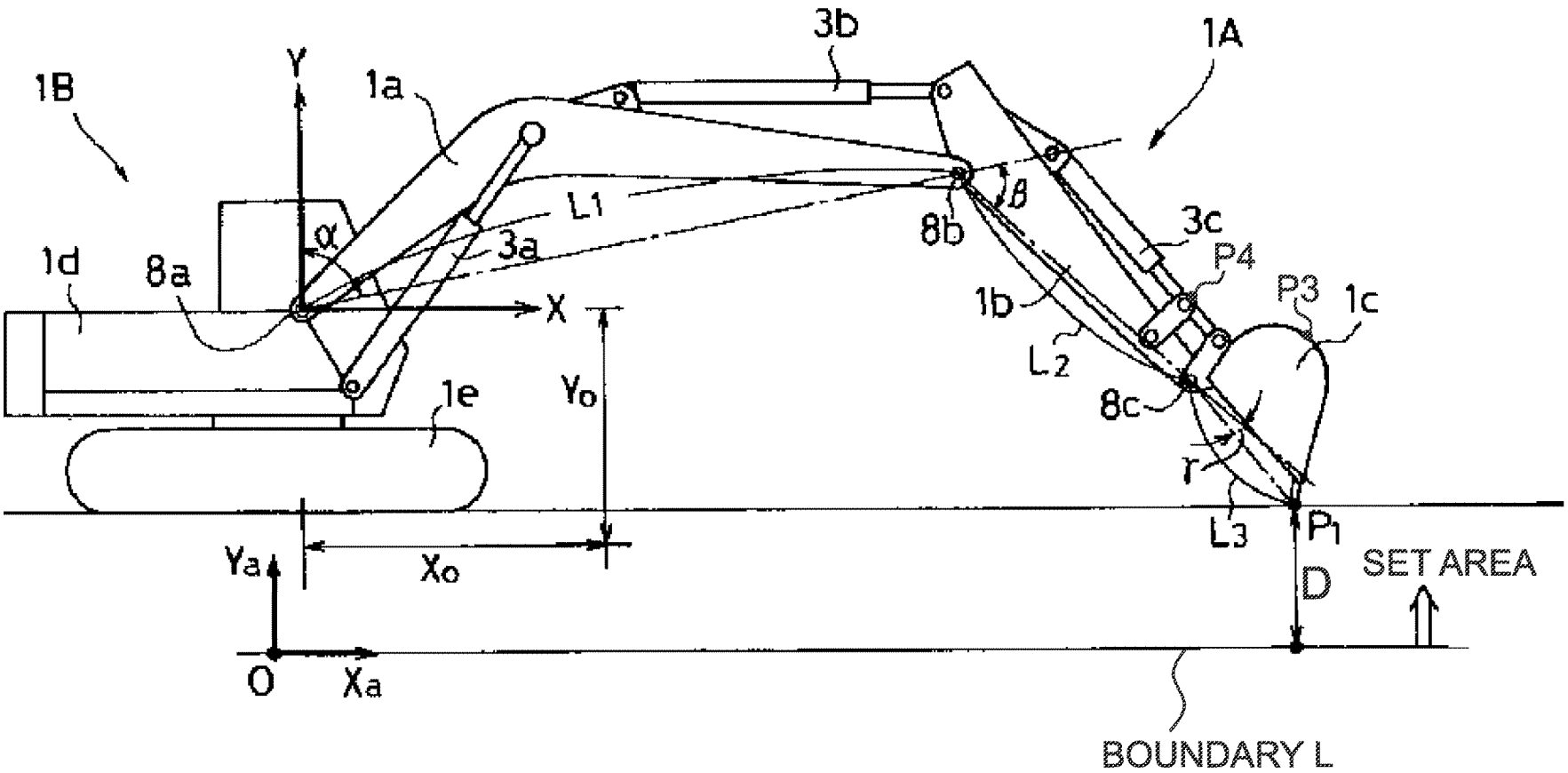
FIG. 4 is an explanatory view for the computation of the position/posture of a front work device 1A.

In FIG. 4, the storage device 93 of the control unit 9 stores the dimension of each portion of the front work device 1A and the machine body 1B, and the front posture computing section 9*a* computes the position of the bucket forward end P1 by using these items of data and the values of rotational angles α, β, and γ detected by the angle sensors 8*a*, 8*b*, and 8*c*. At this time, the position of P1 is obtained as the cooperate values (X, Y) of the XY coordinate system using the rotational fulcrum, for example, of the boom 1*a* as the origin. The XY coordinate system is an orthogonal coordinate system in a vertical plane fixed to the machine body 1B, and can be set in the operational plane. Assuming that the distance between the rotational fulcrum of the boom 1*a* and the rotational fulcrum of the arm 1*b* is L1, that the distance between the rotational fulcrum of the arm 1*b* and the rotational fulcrum of the bucket 1*c* is L2, and that the distance between the rotational fulcrum of the bucket 1*c* and the forward end of the bucket 1*c* is L3, the coordinate values (X, Y) of the XY-coordinate system are obtained from the following equations (1) and (2) based on the rotational angles α, β, and γ.

$$X=L1\cdot\sin\alpha L2\cdot\sin(\alpha+\beta)+L3\cdot\sin(\alpha+\beta+\gamma) \quad (1)$$

$$Y=L1\cdot\cos\alpha+L2\cdot\cos(\alpha+\beta)+L3\cdot\cos(\alpha+\beta+\gamma) \quad (2)$$

The area setting computing section 9*b* performs a set area setting computation based on the target configuration information obtained from the storage device 93. The target configuration information is information in which the final configuration of the excavation object (target configuration) obtained through excavation work by the front work device 1A is defined by a plurality of continuous segments in a vertical plane passing the centers of the boom 1*a*, the arm 1*b*, and the bucket 1*c*. Each segment of the plurality of segments is also referred to as the target surface, and is determined by two points having coordinate information. In the present embodiment, the angles of two adjacent target surfaces (segments) are always different to each other, and the angle of the target surface varies at the end point of each target surface. In the following, the end point of each target surface may be referred to as the "inflection point." The target configuration may be defined by connecting together the target surfaces of the same angle.

The target configuration information is gained, for example, by defining the target configuration by inputting the points on each segment to the operational plane on the spot by using the claw tip or the like of the bucket 1*c* as the reference. Alternatively, in a three-dimensional construction drawing in which the three-dimensional configuration of the target configuration (e.g., face-of-slope configuration) is defined by a polygon, the three-dimensional configuration is cut by a vertical plane passing the centers of the boom 1*a*, the arm 1*b*, and the bucket 1*c*, and the configuration due to a plurality of continuous segments appearing in the section is defined as the target configuration.

In the present embodiment, one target surface (control object surface) of the control object is selected from among a plurality of target surfaces (segments) defining the target configuration in accordance with a predetermined rule, and the area on and above the target surface of the control object constitutes the set area. In the following, the straight line including the target surface of the control object is sometimes referred to as the "boundary L."

First, the boundary L is determined by a linear formula in the XY coordinate system set on the construction machine. Further, when needed, it may be transformed into a linear formula in an orthogonal coordinate system XaYa which has the origin on the straight line and one axis of which is the straight line. In the process, there is obtained transformation data from the XY coordinate system to the XaYa coordinate system. The generation/selection of the boundary L is not limited to the above-mentioned one, and it is possible to adopt various other methods. In one example thereof, the segment having the same X coordinate as the bucket forward end (P1) in the XY coordinate system is retrieved from the section of the three-dimensional construction drawing (target configuration), and the straight line including the segment related to the retrieval result is used as the boundary L.

The control point speed vertical component limiting value computing section 9*c* first determines the control point on the control line based on the positional relationship between the control line and the target surface. As described above, in the case where the control line is above the target surface, the point that is closest to the target surface on the control line is used as the control point, and in the case where the control line crosses the target surface or is below the target surface, the point that intrudes the target surface to the utmost degree on the control line (the point farthest from the target surface) is used as the control point. The control point speed vertical component limiting value computing section 9*c* calculates the limiting value 'a' of the component vertical to the boundary L of the control point speed based on the distance D between the control point on the control line and the boundary D. In calculating the limiting value 'a,' the relationship between the limiting value 'a' and the distance D as shown in FIG. 5 is stored in the storage device 93 of the control unit 9, and this relationship is read.

Figure 5:
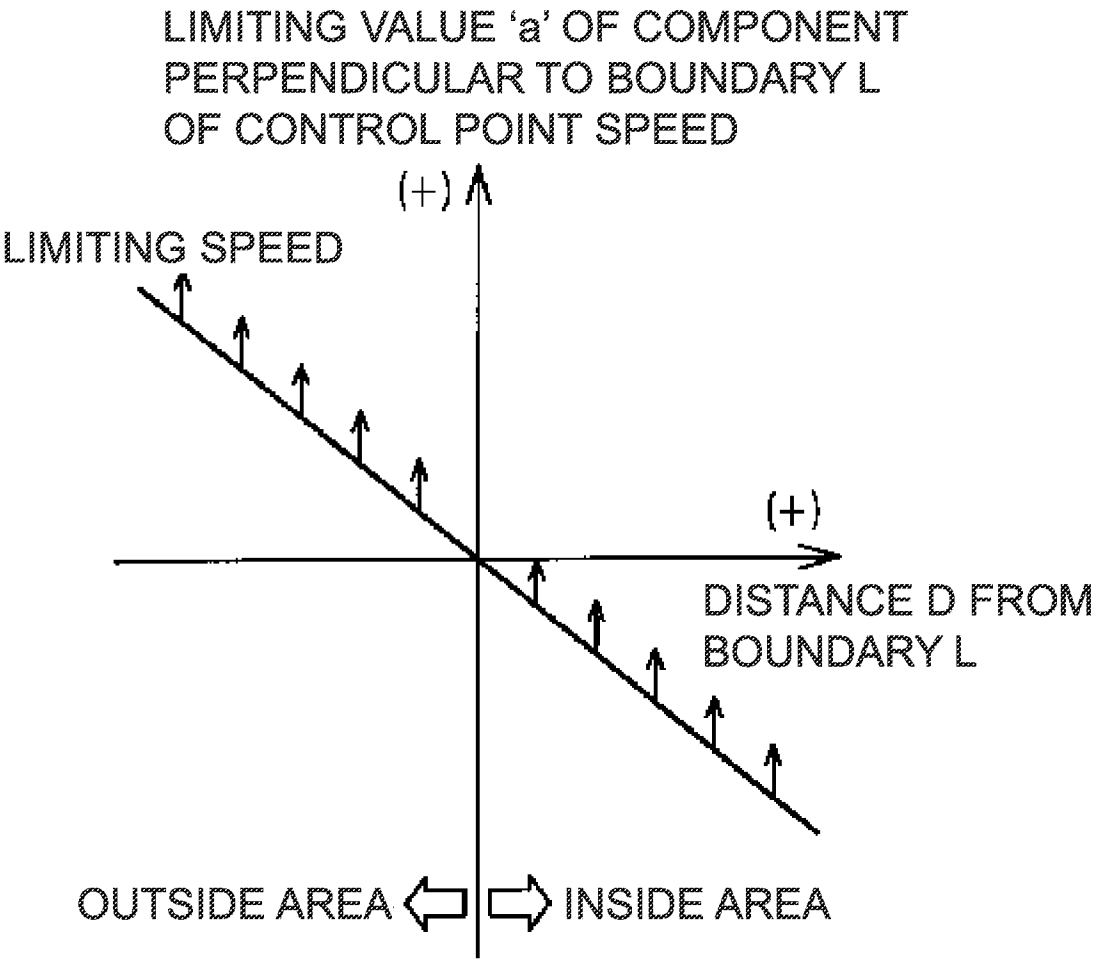
FIG. 5 is a diagram illustrating the relationship between a limiting value 'a' of a control point speed and a distance D from a boundary L of a set area.

In FIG. 5, the horizontal axis indicates the distance D between the control point and the boundary L, and the vertical axis indicates the limiting value 'a' of the component vertical to the boundary L of the control point speed. Regarding the distance D indicated by the horizontal axis and the limiting value 'a' indicated by the vertical axis, the direction from outside the set area into the set area is the (+) direction. The relationship between the distance D and the limiting value 'a' is determined as follows: when the control point is within the set area, the speed in the (−) direction proportional to the distance D is the limiting value 'a' of the component perpendicular to the boundary L of the control point speed. When the control point is outside the area, the speed in the (+) direction proportional to the distance D is the limiting value 'a' of the component perpendicular to the boundary L of the control point speed.

The operator operation arm cylinder speed computing section 9*d* estimates the operator operation arm cylinder speed, which is the arm cylinder speed generated by the operator operation, based on the command value to the flow control valve 5*b* detected by pressure sensor 61*a* and 61*b* (pilot pressure (operation signal)), the flow rate characteristic of the arm flow control valve 5*b*, and the like. That is, the operator operation arm cylinder speed is the arm cylinder speed estimated from the operation signal (pilot pressure) output from the operation lever device 4*b*.

In order to prevent over-excavating and empty excavation at the time of the switching of the target surface (boundary L) of the control object, the arm cylinder target speed computing section 9*z* computes the arm cylinder target speed through the processing of FIG. 9 described below based on the positional relationship between the bucket forward end (first reference point) P1, the bucket rear end (second reference point) Q1, and the inflection point C of the target surface A of the control object as shown in FIG. 7. The arm cylinder target speed is the speed after the deceleration correction of the operator operation arm cylinder speed, and is of a value equal to or less than the operator operation arm cylinder speed in accordance with the presence/absence and magnitude of the deceleration correction.

In FIG. 7, a projection point P2 is a point obtained through projection (positive projection) of the bucket forward end P1 onto the target surface A, and a projection point Q2 is a point obtained through projection (positive projection) of the bucket rear end Q1 onto the target surface. PC2 is the distance between the inflection point C and the projection point P2 of the bucket forward end, and QC2 is the distance between the inflection point C and the projection point Q2 of the bucket rear end. In the situation of FIG. 7 in which the bucket 1*c* moves in the direction of the arrow M, the target surface constituting the control object is A, and the target surface (also referred to as the "next target surface") constituting the next control object is B. The target surface constituting the next control object can be predicted from the moving direction of the bucket 1*c* (speed vector), and the moving direction M of the bucket 1*c* can be predicted from the input to the operation lever device 4.

Figure 8:
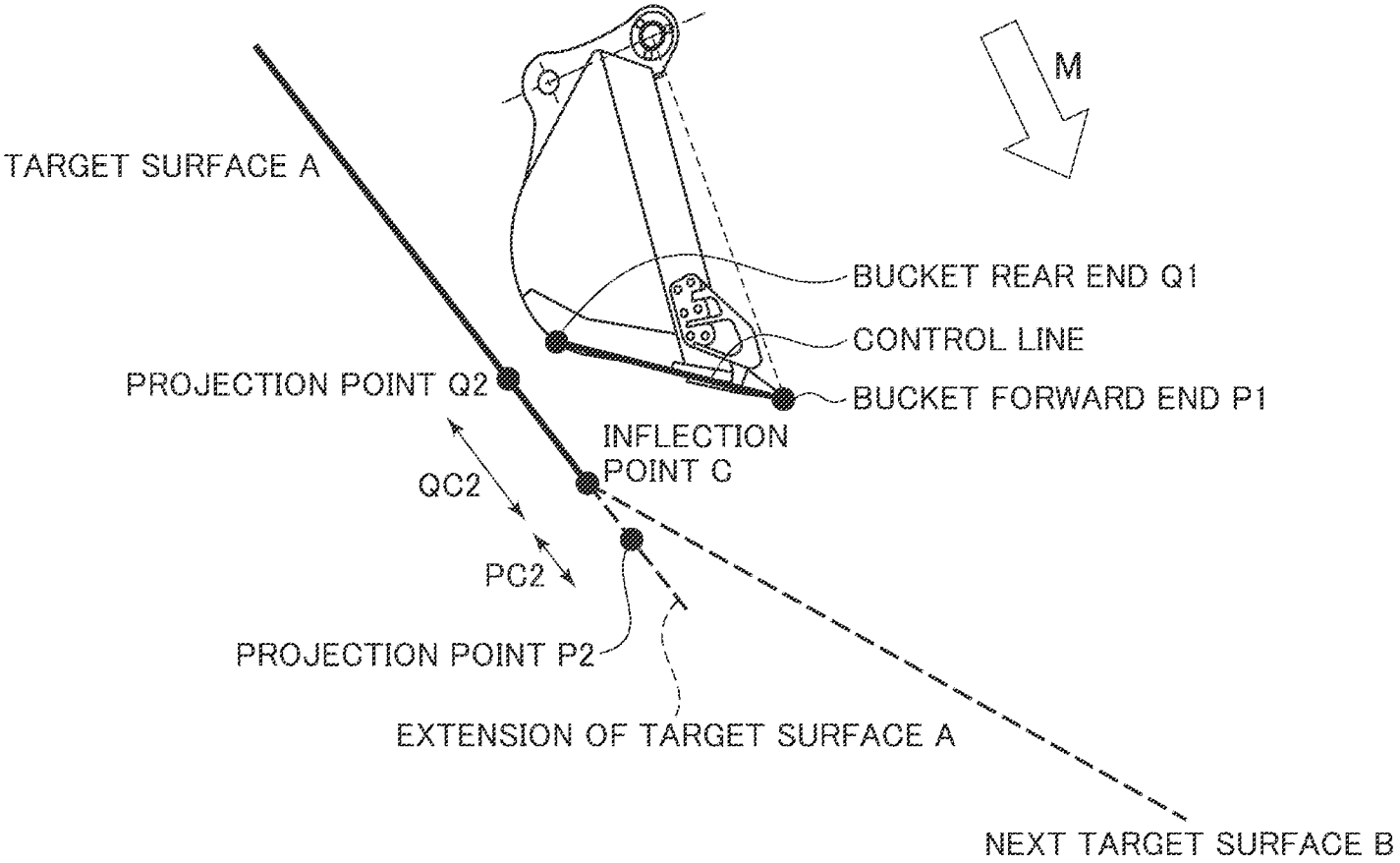
FIG. 8 is a diagram illustrating an example of the positional relationship between the bucket and the inflection point.

On the other hand, FIG. 8 shows a situation in which the bucket 1*c* is situated so as to be astride the inflection point C. Also at this time, the target surface A is the control object, and the points obtained through projection of the bucket forward end P1 and the rear end thereof Q1 onto the target surface A are P2 and Q2. Their distances from the inflection point C are PC2 and QC2.

Figure 15:
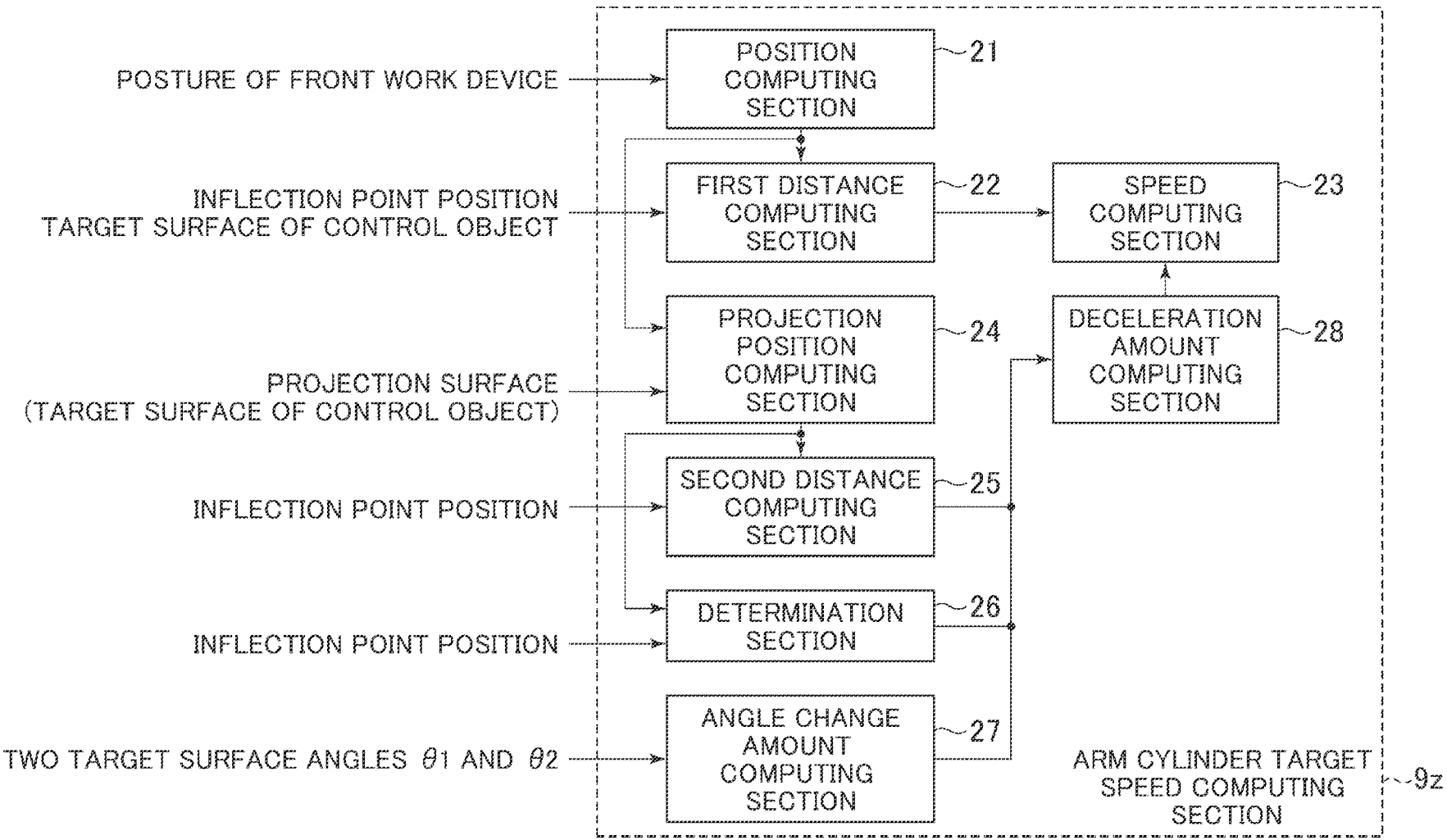
FIG. 15 is a functional block diagram illustrating the control function of the arm cylinder target speed computing section 9*z*.

FIG. 15 shows the control function of the arm cylinder target speed computing section 9*z*. The arm cylinder target speed computing section 9*z* is endowed with the following functions: a position computing section 21, a first distance computing section 22, a speed computing section 23, a projection position computing section 24, a second distance computing section 25, a determination section 26, an angle change amount computing section 27, and a deceleration amount computing section 28.

Stored in the ROM 93 which is a storage device are the two target surfaces (segments) A and B which are connected at different angles in the operational plane (in the XY plane) and which can be the target surfaces constituting the control object, and the position in the operational plane (XY plane) of the inflection point C which is the intersection of the two target surfaces A and B. Further, as the two reference points (the first reference point and the second reference point) that are previously set on the surface of the distal end portion of the work device 1A, there are stored the forward end P1 (first reference point) and the rear end Q1 (second reference point) on the surface of the bucket 1*c* shown in FIG. 7.

The position computing section 21 is a section computing the positions (coordinates) of the first reference point P1 and the second reference point Q1 in the operational plane based on the posture of the front work device 1A computed by the front posture computing section 9*a*.

The first distance computing section 22 is a section calculating the distances PC1 and QC1 from the first reference point P1 and the second reference point Q1 in the operational plane to the target surface A constituting the control object based on the computation result of the position computing section 21 and the position in the operational plane of the target surface A constituting the control object stored in the ROM 93. Here, the distance from the first reference point P1 to the target surface A is the distance PC1, and the distance from the second reference point Q1 to the target surface A is the distance QC1.

The speed computing section 23 is the section computing the arm cylinder target speed based on the computation results of the first distance computing section 22 and the deceleration amount computing section 28. The speed computing section 23 determines the presence/absence of deceleration based on the computation results of the first distance computing section 22. In the case where there is deceleration, it determines the degree of deceleration based on the computation result of the deceleration amount computing section 28. The determination of the presence/absence of deceleration is made based on comparison of the distances from the first reference point P1 and the second reference point Q1 to the inflection point C calculated by the first distance computing section 22 and the magnitude of a predetermined threshold value. More specifically, when the smaller of the two distances is equal to or less than the predetermined threshold value, deceleration is effected (that is, the arm cylinder target speed is a value smaller than the operator operation arm cylinder speed), and no deceleration is effected when the distance exceeds the threshold value (that is, the arm cylinder target speed is of the same value as the operator operation arm cylinder speed). The computation by the deceleration amount computing section 28 will be described below.

The projection position computing section 24 is a section computing the positions in the operational plane of the two projection points P2 and Q2 obtained through projection of the first reference point P1 and the second reference point Q1 onto the target surface A constituting the control object. The angle at which the two control points P1 and Q1 are projected onto the target surface constituting the control object can be varied as appropriate. In the present embodiment, the points obtained through positive projection (orthogonal projection) of the first reference point P1 and the second reference point Q1 onto the target surface constituting the control object are the projection points.

The second distance computing section 25 is a section calculating the distances PC2 and QC2 from the positions of the two projection points P2 and Q2 on the projection surface to the inflection point C based on the computation result of the projection position computing section 24 and the position of the inflection point C. The second distance computing section 25 outputs the smaller of the two calculated distances PC2 and QC2 to the deceleration amount computing section 28.

The determination section 26 is a section determining whether or not the inflection point C exists between the two projection points P2 and Q2 on the surface of the projection object and in the extension thereof (that is, on the target surface A of the control object and in the extension thereof). For example, in the state of FIG. 8, the inflection point C exists between the two projection points P2 and Q2 on the target surface A or in the extension thereof, and the result of the determination is "YES," and in the state of FIG. 7, no inflection point C exists between the two projection points P2 and Q2, so that the determination result is "NO." The determination section 26 outputs the determination result to the deceleration amount computing section 28.

Figure 10:
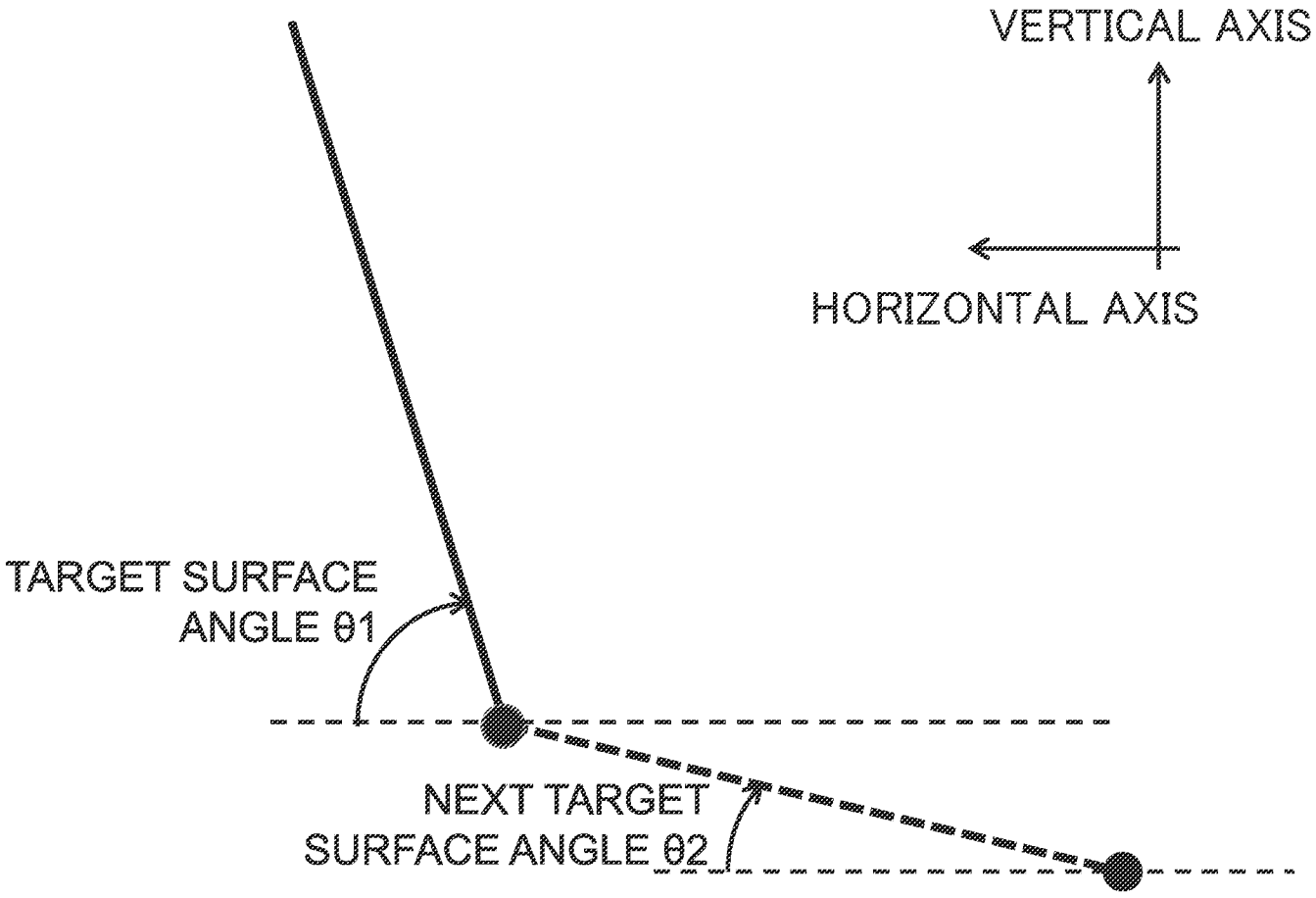
FIG. 10 is a conceptual drawing illustrating a target surface angle.

The angle change amount computing section 27 is a section which derives the difference between the target surface angle θ1 of the target surface of the control object (the target surface A in the case of FIG. 7) and the target surface angle θ2 of the target surface of the next control object (the target surface B in the case of FIG. 7) and which calculates the absolute value of the difference as the angle change amount. FIG. 10 is a conceptual drawing illustrating the angle change amount. The angles θ1 and θ2 of the target surface (the target surface angle) are given as the inclination of the reference coordinate system (e.g., the XY plane constituting the operational plane) with respect to the horizontal axis. The angle change amount is the absolute value of the difference between the target surface angle θ1 of the control object and the target surface angle θ2 of the next control object. The angle change amount computing section 27 outputs the computation result of the angle change amount to the deceleration amount computing section 28.

The deceleration amount computing section 28 is a section computing the deceleration amount (the index of to what degree the deceleration correction is to be effected) in the case where deceleration correction is effected on the operator operation arm cylinder speed based on the computation results and the like of the second distance computing section 25, the determination section 26, and the angle change amount computing section 27. The deceleration amount computing section 28 will be described in detail with reference to FIG. 9.

Figure 9:
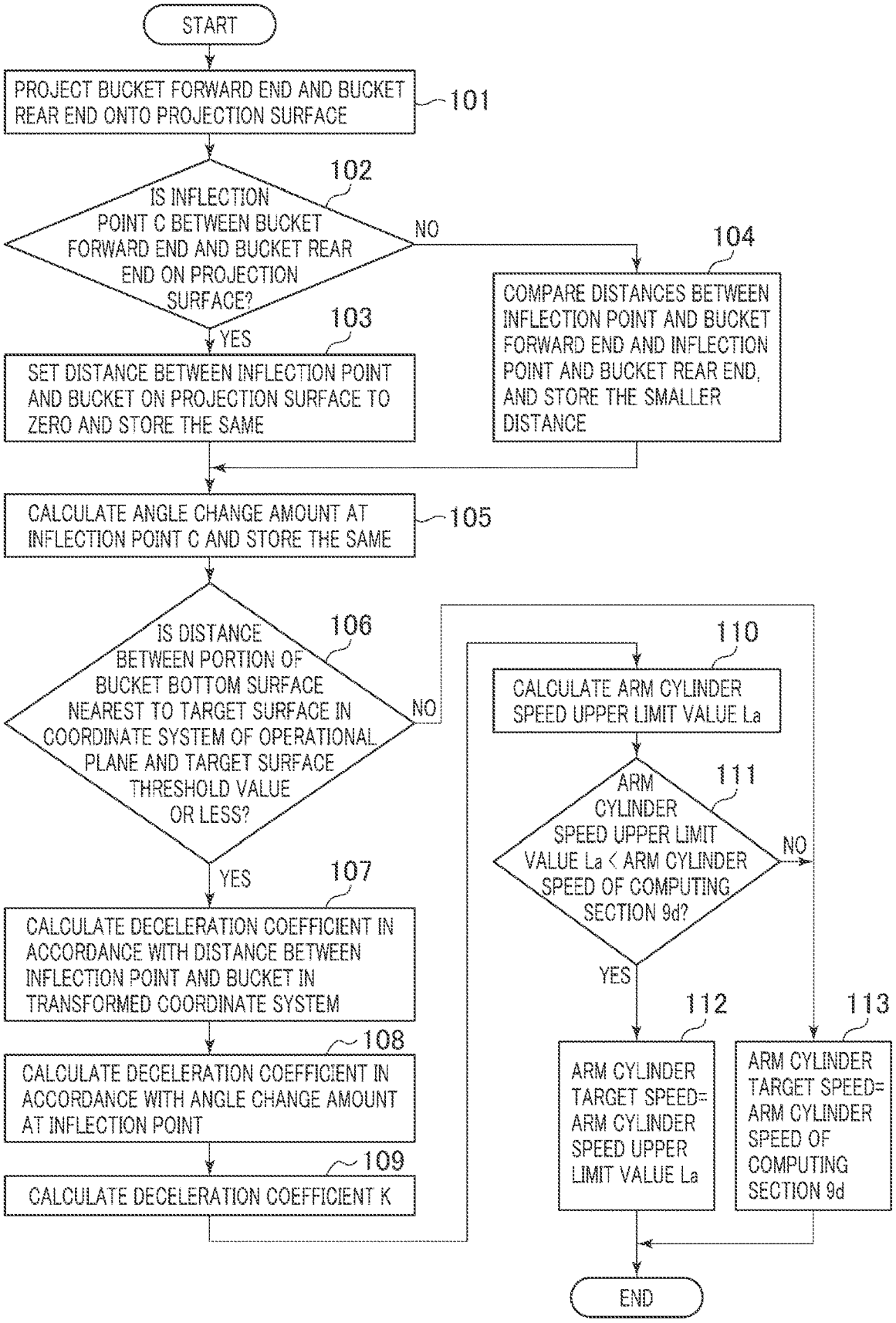
FIG. 9 is a flowchart illustrating deceleration processing by an arm cylinder target speed computing section 9*z*.

FIG. 9 is a flowchart illustrating the deceleration processing by the arm cylinder target speed computing section 9*z*.

First, in step 101, the projection position computing section 24 projects P1 and Q1 onto the target surface A (projection surface) of the control object based on the positions of the bucket forward end P1 and the bucket rear end Q1 calculated by the position computing section 21, and gains the projection points P2 and Q2. At this time, the inflection point C is also projected in the case where there is no inflection point C on the projection surface.

In step 102, the determination section 26 determines whether or not the inflection point C is between the two projection points P2 and Q2 on the projection surface. In the case where it is determined that the inflection point C is between the two projection points P2 and Q2 (e.g., in the case of FIG. 8), the procedure advances to step 103. In step 103, the deceleration amount computing section 28 sets the distance between the inflection point C and the bucket 1*c* to zero, and stores this in the ROM 93.

On the other hand, in the case where it is determined in step 102 that the inflection point C is not between the two projection points P2 and Q2, the procedure advances to step 104. In step 104, the deceleration amount computing section 28 stores the smaller of the distances PC2 and QC2 (see FIGS. 7 and 8) from the two projection points P2 and Q2 to the inflection point C calculated by the second distance computing section 25 as the distance between the inflection point C and the bucket 1*c*.

In step 105, the angle change amount computing section 27 derives the difference between the target surface angle θ1 of the control object at the time of execution of the flowchart and the target surface angle θ2 of the next control object, and stores the absolute value thereof as the angle change amount.

In step 106, it is determined whether or not, in the coordinate system of the operational plane, the distance between the portion of the segment connecting the bucket forward end P1 and the bucket rear end Q1 (this segment (control line) is also referred to as the "bucket bottom surface"), the portion being closest to the target surface A, and the target surface A is equal to or lower than a threshold value T1. In the present embodiment, in making this determination, the first distance computing section 22 calculates the distances PC1 and QC1 from the two reference points P1 and P2 to the target surface A, and the speed computing section 23 determines whether or not the smaller of PC1 and QC1 is equal to or lower than the threshold value T1. In the case where the distance is larger than the threshold value T1, the procedure advances to step 113, and no deceleration due to approach to the inflection point C is effected. In the case where, in step 106, the smaller of the distances PC1 and QC1 is not more than the threshold value T1, the procedure advances to step 107.

Figure 11:
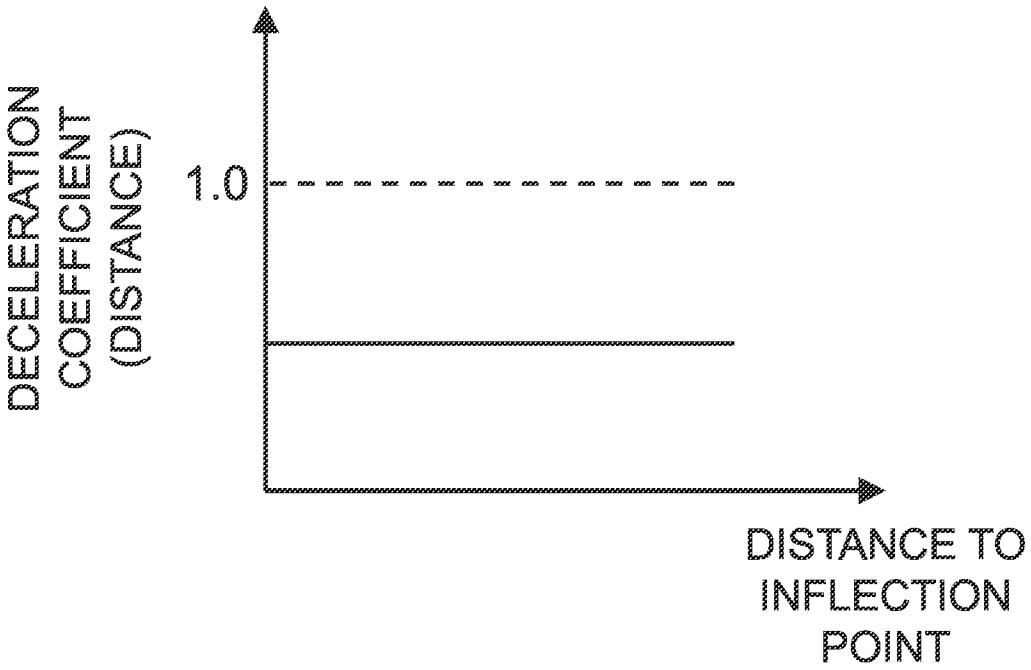
FIG. 11 is a diagram illustrating an example of the relationship between a distance to an inflection point and a deceleration coefficient.
Figure 12:
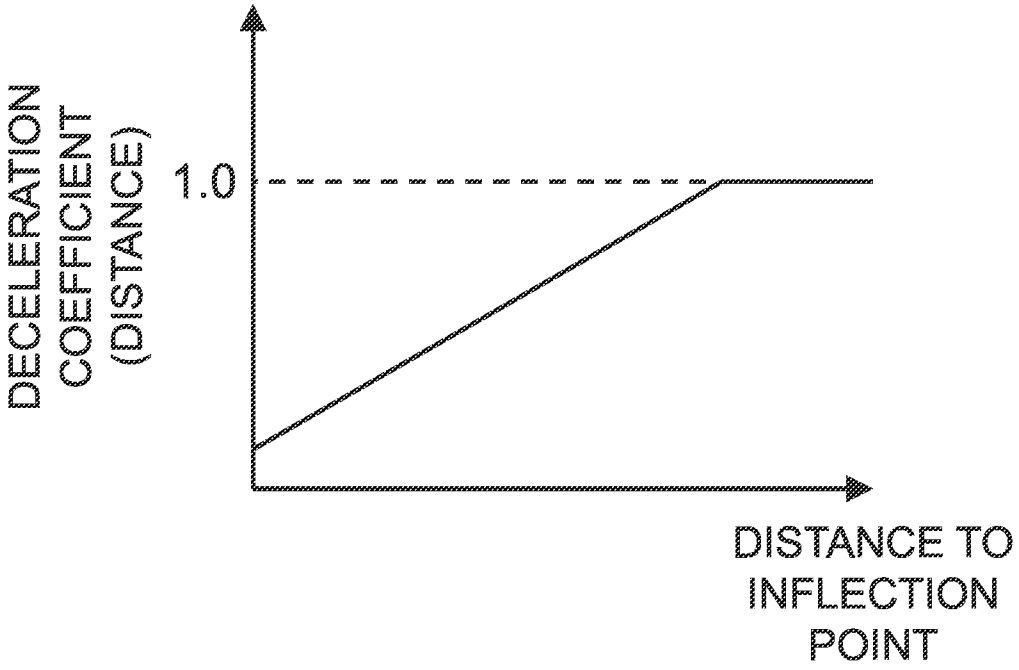
FIG. 12 is a diagram illustrating an example of the relationship between the distance to the inflection point and the deceleration coefficient.

In step 107, by using the distance between the inflection point C determined in step 103 or 104 and the bucket 1*c* (that is, zero or the smaller of PC2 and QC2) and a function determining the relationship between the distance and the deceleration coefficient, the deceleration amount computing section 28 determines the deceleration coefficient (distance coefficient Kd) in the case where deceleration correction is effected on the operator operation arm cylinder speed. The distance coefficient Kd is a value more than 0 and not more than 1. As the function, it is desirable to utilize one in which the distance coefficient Kd decreases in accordance with a reduction in the distance (e.g., see the function of FIG. 12) in order to achieve a sufficient deceleration. It is also possible, however, to utilize a function in which the distance coefficient Kd is uniform independently of the distance (e.g., see the function of FIG. 11). The former function is not limited to that shown in FIG. 12. It is possible to utilize various other functions such as a step-like function, a curved function, or a function in which the reduction ratio of the distance coefficient Kd increases as the distance decreases.

In particular, in step 107, in the case where it is determined in step 102 that the inflection point is between the bucket forward end and the bucket rear end, the distance between the inflection point C and the bucket 1*c* is zero, so that the deceleration due to the inflection point C continues to act until either the bucket forward end P1 or the bucket rear end Q1 passes the inflection point C. That is, in the case where the former function is utilized, the deceleration due to the distance is maximum when the distance is zero, and the deceleration is maximum until the bucket passes the inflection point, so that it is possible to prevent the bucket 1*c* from being inadvertently allowed to go over the target surface.

Figure 13:
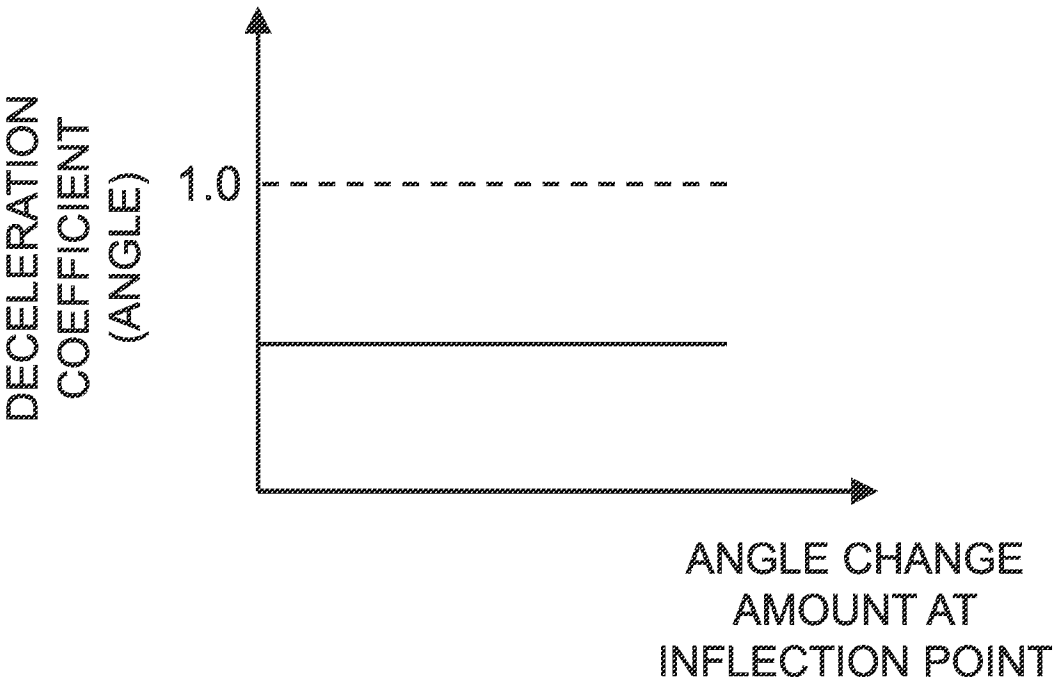
FIG. 13 is a diagram illustrating an example of the relationship between an angle change amount at the inflection point and the deceleration coefficient.
Figure 14:
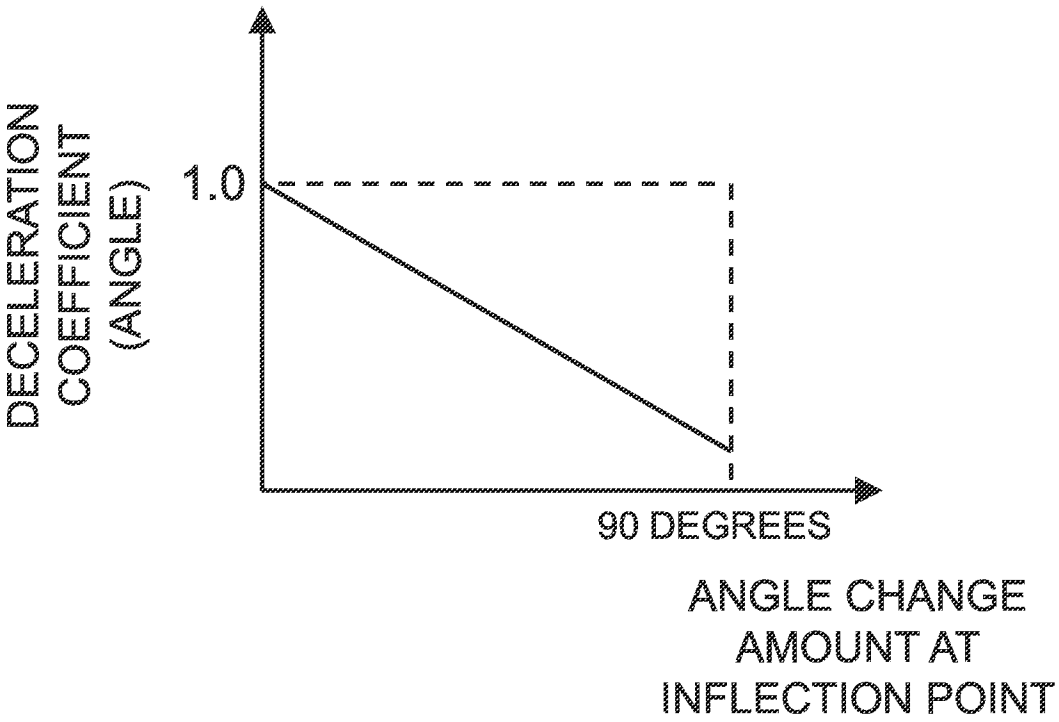
FIG. 14 is a diagram illustrating an example of the relationship between the angle change amount at the inflection point and the deceleration coefficient.

In step 108, by using the function determining the relationship between the angle change amount at the inflection point C computed by the angle change amount computing section 27 and the deceleration coefficient, the deceleration amount computing section 28 determines the deceleration coefficient (angle coefficient Ka) in the case where deceleration correction is effected on the operator operation arm cylinder speed. Also regarding this function, it is possible to utilize one similar to that of step 107. That is, it is possible to utilize, for example, a function in which the angle coefficient Ka decreases as the angle change amount increases (see FIG. 14) or a function in which the angle coefficient Ka is uniform independently of the angle change amount (see FIG. 13).

In step 109, the deceleration amount computing section 28 calculates the deceleration coefficient K from the distance coefficient Kd of step 107, the angle coefficient Ka of step 108, and the following equation (3), and the procedure advances to step S110. Similarly to Kd and Ka, the deceleration coefficient K is a value more than 0 and equal to or lower than 1. The smaller the values of these coefficients, the smaller the arm cylinder speed upper limit value La (that is, the deceleration is the larger).

$$\text{Deceleration coefficient } K = 1-(1-\text{distance coefficient } Kd)\times(1-\text{angle coefficient } Ka) \quad (3)$$

In step 110, the speed computing section 23 sets the arm cylinder speed upper limit value La based on the arm cylinder maximum speed stored in the storage device 93, the deceleration coefficient K calculated in step 109, and the following equation (4), and the procedure advances to step 111.

$$\text{Arm cylinder speed upper limit value } La = \text{arm cylinder maximum speed}\times\text{deceleration coefficient } K \quad (4)$$

In step 111, the speed computing section 23 determines whether or not the arm cylinder speed obtained by the operator operation arm cylinder speed computing section 9*d* exceeds the arm cylinder speed upper limit value La determined in step 110. When it is determined that it does, it is determined that deceleration is necessary, and the procedure advances to step 112.

In step 112, the speed computing section 23 sets the arm cylinder speed upper limit value La calculated in step 110 as the arm cylinder target speed instead of the arm cylinder speed obtained by the computing section 9*d*, thereby completing the processing.

On the other hand, in the case where it is determined in step 111 that the operator operation arm cylinder speed does not exceed the arm cylinder speed upper limit value La, it is regarded that no deceleration based on the inflection point C is to be effected, and the procedure advances to step 113. The speed computing section 23 sets the operator operation arm cylinder speed obtained by the operator operation arm cylinder speed computing section 9*d* as it is as the arm cylinder target speed, thereby completing the processing.

In this way, the arm cylinder 3*b* is decelerated in accordance with the distance from the inflection point, whereby it is possible to effect appropriate deceleration only when necessary. That is, no unnecessary deceleration is effected when there is no fear of the intrusion of the target surface. In a situation where deceleration is necessary, it is possible to execute appropriate deceleration on both the forward end P1 and the rear end Q1 of the bucket 1*c* in accordance with the angle change amount and the distance to the inflection point.

Instead of the deceleration method utilizing the above equation (4), it is possible to effect deceleration by calculating the arm cylinder target speed by directly multiplying the operator operation arm cylinder speed by the deceleration coefficient K as shown in the following equation (5). Further, as shown in the following equation (6), it is also possible to multiply the arm pilot pressure by the deceleration coefficient K, and then to effect deceleration through calculation of the operator operation arm cylinder speed again.

$$\text{Arm cylinder target speed} = \text{operator operation arm cylinder speed}\times\text{deceleration coefficient } K \quad (5)$$

$$\text{Arm target pilot pressure} = \text{arm pilot pressure}\times\text{deceleration coefficient } K \quad (6)$$

Further, regarding the distance coefficient Kd of step 107 and the angle coefficient Ka of step 108, it is possible to calculate the deceleration coefficient K by solely taking into consideration one of them, and instead of depending on the distance and the angle change amount, it is possible to obtain a predetermined value as the final deceleration coefficient K solely under the condition that one of the distances Pc1 and QC1 is equal to or less than the threshold value T1.

Further, it is also possible to calculate the arm cylinder target speed by calculating, instead of the deceleration coefficient, a deceleration amount reducing the arm cylinder maximum speed, the operator operation arm cylinder speed, or the arm pilot pressure, and by subtracting the deceleration amount from the arm cylinder maximum speed, the operator operation arm cylinder speed, or the arm pilot pressure.

Referring back to FIG. 3, the arm control point speed computing section 9*e* computes the arm 1*b* control point speed b, which is the control point speed generated by the arm 1*b* operation, based on the arm cylinder target speed obtained through a series of procedures in FIG. 9 by the arm cylinder target speed computing section 9*z*, and the position and posture of the front work device 1A obtained by the front posture computing section 9*a*. The control point speed b is a vector value.

Figure 16:
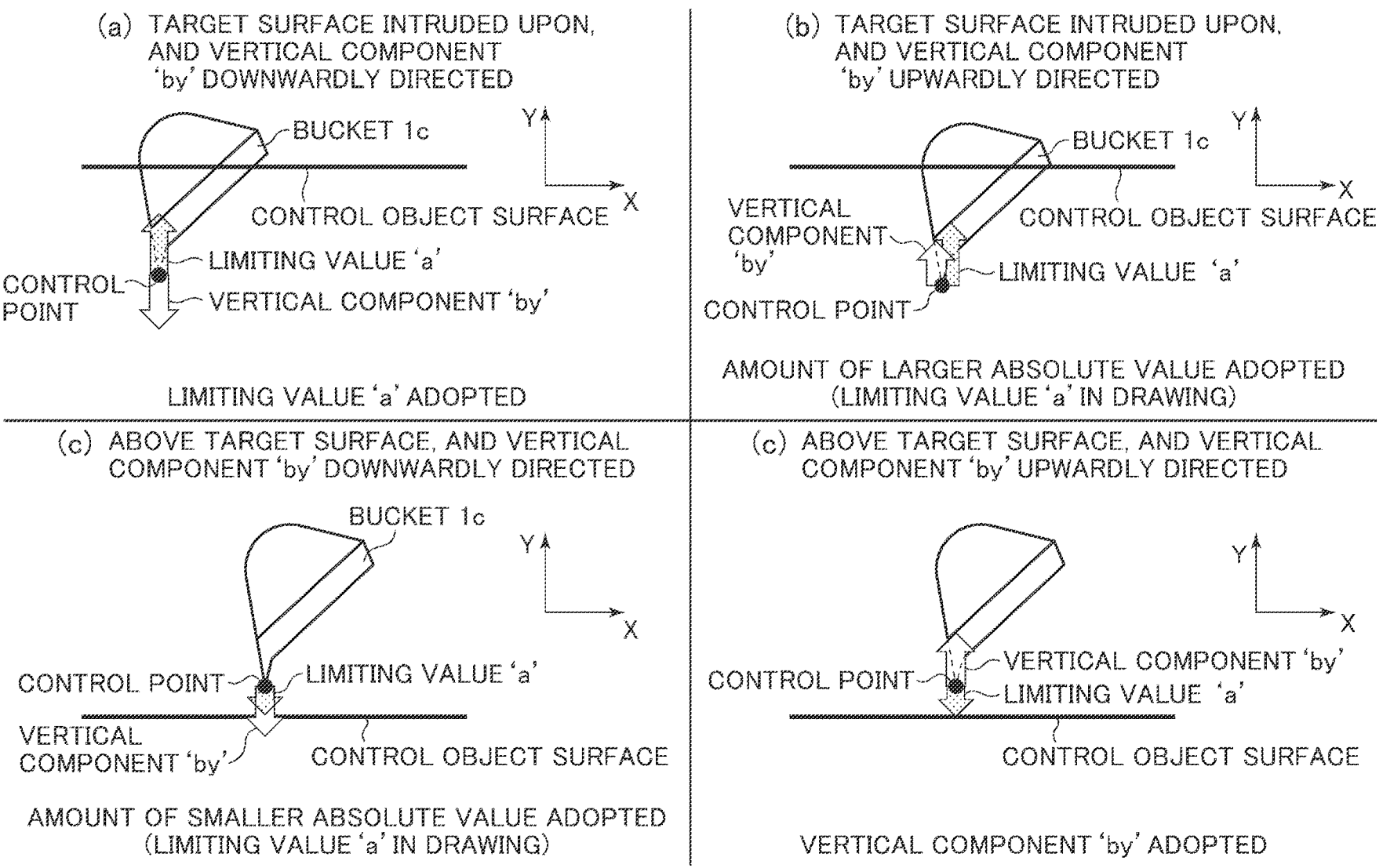
FIG. 16 is a diagram illustrating a difference in a vertical component c of a boom control point speed for each combination of the position of a control point with respect to the target surface and a vertical component 'by.'

The boom control point speed vertical component computing section 9*f* first computes (bx, by) that are a component (X component) horizontal to the boundary L and a component (Y component) vertical thereto from the arm 1*b* control point speed b obtained by the computing section 9*e*. Then, it determines the target value d of the vertical component of the control point speed based on the vertical relationship between the target surface constituting the control object and the control point, the direction of the vertical component 'by' of the arm control point speed, and the magnitudes of the vertical component 'by' of the arm control point speed and the limiting value ay, computing the boom control point speed vertical component c, which is the control point speed vertical component c generated by the boom operation, that is capable of outputting the target value d is realized. More specifically, as shown in FIG. 16, the computing section 9*f* of the present embodiment effects classification into cases (a) through (d) to determine the target value d, and, based on that, computes the vertical component c of the boom control point speed. Next, the computation of the vertical component c based on the cases (a) through (d) will be described.

(a) In the case where the control point exists below the target surface of the control object (also referred to as the "control object surface") and where the vertical component 'by' of the arm control point speed computed 'by' the computing section 9*e* is downwardly directed ((−) direction), the limiting value 'a' (upwardly directed) is adopted as the target value d. As a result, the vertical component c of the boom control point speed is 'a−by' (c=a−by).

(b) In the case where the control point is below the control object surface and where the vertical component 'by' of the arm control point speed is upwardly directed ((+) direction), of the vertical component 'by' of the arm control point speed and the limiting value 'a,' the one of a larger absolute value is adopted as the target value d. As a result, the vertical component c of the boom control point speed is 'a−by' when the absolute value of the limiting value 'a' is larger, and when the absolute value of the vertical component 'by' is larger, it is zero.

(c) In the case where the control point is above the control object surface and where the vertical component 'by' of the arm control point speed is downwardly directed ((−) direction), of the vertical component 'by' of the arm control point speed and the limiting value 'a,' the one of a smaller absolute value is adopted as the target value d. As a result, the vertical component c of the boom control point speed is 'a−by' when the absolute value of the limiting value 'a' is smaller, and when the absolute value of the vertical component 'by' is smaller, it is zero.

(d) In the case where the control point exists above the control object surface and where the vertical component 'by' of the arm control point speed upwardly directed ((+) direction), the vertical component 'by' of the arm control point speed (upwardly directed) is adopted as the target value d. As a result, the vertical component c of the boom control point speed is zero.

In the case where the control point (in many cases, the claw tip of the bucket 1*c*) is on the control object surface, the limiting value 'a' is zero, and the vertical component of the control point speed is maintained to be zero, so that when, for example, the arm 1*b* is caused to perform crowding operation near the control object surface, it is possible to realize an excavating operation along the control object surface due to the horizontal component of the control point speed.

Referring back to FIG. 3, the machine-control boom cylinder speed computing section 9*g* computes the machine-control boom cylinder speed, which is the boom cylinder speed generated by the machine-control, based on the component c vertical to the boundary L of the boom 1*a* control point speed, the position and posture of the front work device 1A, etc.

The boom pilot pressure computing section 9*h* obtains a boom pilot pressure corresponding to the boom cylinder speed obtained by the computing section 9*g* based on the flow rate characteristic of the flow control valve 5*a* of the boom 1*a*.

The arm pilot pressure computing section 9*j* obtains an arm pilot pressure corresponding to the bucket forward end speed b due to the arm 1*b* obtained by the arm control point speed computing section 9*e* based on the flow rate characteristic of the flow control valve 5*b* of the arm 1*b*.

In the case where the area limiting switch 7 is ON (i.e., being depressed) and where area limiting control is selected (permitted), the area limiting control switching computing section 9*r* outputs the value calculated as the boom pilot pressure by the computing section 9*h* is output as it is to the boom command computing section 9*i*, and outputs the value calculated as the arm pilot pressure by the computing section 9*j* as it is to the arm command computing section 9*k*. On the other hand, in the case where the area limiting switch 7 is OFF (not being depressed) and area limiting control is not selected (i.e., prohibited), the larger value of the pilot pressures detected by the pressure sensors 60*a* and 60*b* is output to the boom command computing section 9*i* as the boom pilot pressure, and the larger value of the pilot pressures detected by the pressure sensors 61*a* and 61*b* is output to the arm command computing section 9*k* as the arm pilot pressure. When the value detected by the sensor 60*b* or the sensor 61*b* is output, it is output as a negative value.

The boom command computing section 9*i* inputs therein the pilot pressure from the area limiting control switching computing section 9*r*. In the case where this value is positive, the pilot pressure is corrected by outputting power as appropriate to the solenoid proportional valve 10*a* such that the pilot pressure of the hydraulic drive section 50*a* of the flow control valve 5*a* is the value output from the switching computing section 9*r*, and 0 voltage is output to the solenoid proportional valve 10*b* to set the pilot pressure of the hydraulic drive section 50*b* of the flow control valve 5*a* to 0. In the case where the limiting value is negative, the pilot pressure is corrected by outputting power as appropriate to the solenoid proportional valve 10*b* such that the pilot pressure of the hydraulic drive section 50*b* of the flow control valve 5*a* is the value output from the switching computing section 9*r*, and 0 voltage is output to the boom raising side solenoid proportional valve 10*a* to set the pilot pressure of the hydraulic drive section 50*a* of the flow control valve 5*a* to 0.

The arm command computing section 9*k* inputs therein the pilot pressure from the area limiting control switching computing section 9*r*. In the case where this value is positive, the pilot pressure is corrected by outputting power as appropriate to the solenoid proportional valve 11*a* such that the pilot pressure of the hydraulic drive section 51*a* of the flow control valve 5*b* is the value output from the switching computing section 9*r*, and 0 voltage is output to the solenoid proportional valve 11*b* to set the pilot pressure of the hydraulic drive section 51*b* of the flow control valve 5*b* to 0. In the case where the limiting value is negative, the pilot pressure is corrected by outputting power as appropriate to the solenoid proportional valve 11*b* such that the pilot pressure of the hydraulic drive section 51*b* of the flow control valve 5*b* is the value output from the switching computing section 9*r*, and 0 voltage is output to the arm damping side solenoid proportional valve 11*b* to set the pilot pressure of the hydraulic drive section 51*a* of the flow control valve 5*a* to 0.

Next, the feature of the above embodiment will be described.

(1) According to the above embodiment, there is provided a work machine (hydraulic excavator) including: a multi-joint type work device (e.g., a work device 1A) formed by connecting a plurality of driven members (e.g., a boom 1*a*, an arm 1*b*, and a bucket 1*c*) and configured to operate in a predetermined operational plane (e.g., in an XY plane or an XaYa plane); a plurality of hydraulic actuators (e.g., a boom cylinder 3*a*, an arm cylinder 3*b*, and a bucket cylinder 3*c*) respectively driving the plurality of driven members based on an operation signal (e.g., a pilot pressure); an operation device (an operation lever device 4) outputting the operation signal to a hydraulic actuator of the plurality of hydraulic actuators, desired by the operator; and an operation control section 900 (a control unit 9) that executes area limiting control such that the work device moves on a target surface (on a target surface A or on a boundary L) of a control object or in an area above the same (within a set area), by outputting the operation signal to at least one of the plurality of actuators or by correcting the operation signal output to at least one of the plurality of hydraulic actuators. The operation control section is equipped with a storage device (e.g., a ROM 93 of the control unit 9) storing two segments (target surfaces A and B) that are connected at a different angle in the operational plane and that can be the target surface of the control object, a position of an inflection point C that is the intersection of the two segments in the operation plane, and a first reference point P1 and a second reference point Q1 set at a distal end portion (the bucket 1*c*) of the work device, a position computing section 21 (control unit 9) computing the positions of the first reference point P1 and the second reference point Q1 in the operational plane based on the posture of the work device 1A, and a first distance computing section 22 (control unit 9) calculating distances PC1 and QC1 from the first reference point P1 and the second reference point Q1 in the operational plane to the target surface of the control object; and when the smaller of the distances PC1 and QC1 from the first reference point P1 and the second reference point Q1 to the target surface of the control object is equal to or lower than a threshold value T1, the operation control section 900 corrects an operation signal output from the operation device so as to reduce the operational speed of a hydraulic actuator (e.g., the arm cylinder 3*b*) that is the control target of the operation signal.

For example, when it is determined whether or not the deceleration of the arm cylinder 3*b* is necessary based on the distance from one reference point set at the distal end portion of the work device 1A (e.g., the control point set at the claw tip of the bucket 1*c*) to the inflection point C, deceleration cannot be effected when another point on the bucket 1*c* which is not the reference point approaches the target surface of the control object, and there is a fear of the bucket 1*c* coming into contact with the target surface or getting below the target surface. However, when, as in the present embodiment, it is determined whether or not the deceleration of the arm cylinder 3*b* is necessary based on the magnitudes of the distances PC1 and QC1 from the two reference points P1 and Q1 set at the distal end portion of the work device 1A to the inflection point C as in the present embodiment, the deceleration of the arm cylinder 3*b* is executed when one of the two reference points P1 and Q1 approaches the target surface of the control object, so that it is possible to reliably prevent the work device 1A (control point) from intruding into the target surface.

As the first reference point and the second reference point, it is possible to arbitrarily select points suitable for determining whether or not the distal end portion of the work device 1A has approached the target surface from the surface of the bucket 1*c* and the vicinity thereof (the distal end portion of the work device 1A). That is, a point other than the bucket forward end P1 and the bucket rear end Q1 can be selected. For example, it is also possible to select a point at the bottom surface P3 (see FIG. 4) of the bucket 1*c* or a point at the outermost portion P4 of the bucket link (see FIG. 4). Further, it is also possible to select three or more reference points so long as they are on the surface of the distal end portion of the work device 1A, performing the control of the present application based on the reference points or the distances from the projection points thereof to the inflection point.

(2) In the above embodiment, the work machine of the above item (1) may further include: a projection position computing section 24 (control unit 9) calculating the positions, in the operational plane, of two projection points P2 and Q2 obtained through projection of the first reference point P1 and the second reference point Q1 onto the target surface of the control object, and a second distance computing section 25 (control unit 9) calculating the distances PC2 and QC2 from the positions of the two projection points in the operational plane to the inflection point C. In the case where the operation control section 900 reduces the operational speed of the hydraulic actuator (e.g., the arm cylinder 3*b*) constituting the control target of the operation signal, the smaller the smaller of the distances PC2 and QC2 from the two projection points to the inflection point, the smaller the deceleration coefficient (Kd), whereby the degree of reduction is set to be large.

Here, as compared with the smaller of the distances PC1 and QC1 from the two reference points P1 and Q1 to the target surface A and the smaller of the distances from P1 and Q1 to the inflection point C, the smaller of the distances PC2 and QC2 from the two projection points P2 and Q2 to the inflection point C serves as an appropriate index indicating the degree of approach of the bucket 1*c* and the inflection point C on the target surface A, and also serves as an index indicating the approximation degree of the next target surface B subsequent to the inflection point C and the bucket 1*c*. If, in order to prevent intrusion into the next target surface B, the deceleration degree is determined using the distances PC1 and QC1 as the references, there is a fear of the deceleration becoming excessive to cause the operator to experience discomfort. However, when, as in the present embodiment, the deceleration degree is determined by using the distances PC2 and QC2 as the reference, the deceleration degree is determined by using the approximation degree of the next target surface B and the bucket 1*c*, so that there is no excessive deceleration, and it is possible to prevent intrusion into the next target surface B. In the present structure, proper deceleration is executed in the case where the smaller value of PC2 and QC2 is smaller than the smaller value of PC1 and QC1 (e.g., in the case of FIG. 7), whereby a particularly marked effect is achieved.

It is not necessary for the surface (projection surface) onto which the two reference points P1 and P2 and the inflection point C are projected to be the target surface of the control object. It is only necessary for the positional relationship on the straight line with respect to the inflection point C to be the same. For example, the projection surface may be a surface obtained by rotating the target surface of the control object around the inflection point C by the same amount as the target surface angle thereof. Further, a surface obtained through parallel translation of the target surface A along with the inflection point C may be used as the projection surface.

(3) In the above embodiment, the work machine of the above (2) may further include a determination section 26 (control unit 9) determining whether or not the inflection point C exists between the two projection points P2 and Q2 on the target surface of the control object or in the extension thereof. When the smaller of the distances from the first reference point P1 and the second reference point Q1 to the target surface of the control object is equal to or lower than the threshold value T1, and when the determination section 26 determines that the inflection point C exists between the two projection points P2 and Q2, the operation control section 900 corrects the operation signal output from the operation device such that the reduction degree of the operational speed of the hydraulic actuator (e.g., the arm cylinder 3*b*) constituting the control target of operation signal is set to the maximum value of the reduction degree set based on the smaller of the distances PC2 and QC2 in the above item (2) (the value when the distance is zero).

In the case where the inflection point C exists between the two projection points P2 and Q2, the existence of the bucket 1*c* at a position sufficiently close to the next target surface is to be predicted. In the present embodiment, in such a case, the deceleration degree based on the distances PC2 and QC2 is made maximum. This helps to prevent intrusion into the next target surface. While in the embodiment described above the deceleration degree is a "maximum value," this should not be construed limitedly. It is only necessary for the hydraulic actuator to be decelerated further than the deceleration degree set based on the smaller of the distances PC2 and QC2. It is also possible to use a value beyond the maximum value.

(4) Further, in the above embodiment, the work machine according to above (3) may further include an angle change amount computing section 27 (control unit 9) calculating the angle change amount which is the absolute value of the difference between the target surface angle θ1 of the target surface constituting the control object and the target surface angle θ2 of the target surface constituting the next control object. In the case where the operation control section 900 reduces the operational speed of the hydraulic actuator (e.g., the arm cylinder 3*b*) constituting the control target of the operation signal, the reduction degree is set to be the larger the larger the angle change amount.

When the deceleration is thus effected in accordance with the angle change amount, it is possible to sufficiently decelerate the actuator even in the case where the angle made by the target surface angles is acute, making it possible to prevent intrusion into the bucket 1*c* of the next target surface.

ADDITIONAL REMARK

Figure 17:
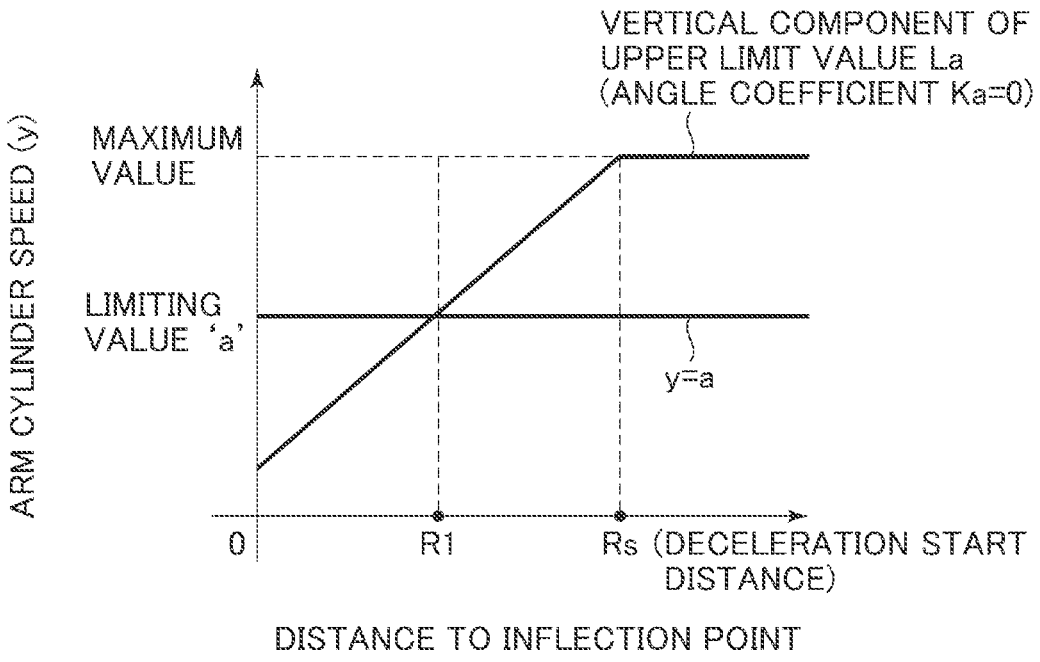
FIG. 17 is a diagram illustrating an example of the case where a deceleration coefficient K is set such that at less than a distance R1 in the vicinity of the inflection point, an upper limit value La is smaller than a limiting value 'a.'

In the case where the vertical component of the upper limit value La and the limiting value 'a' are compared with each other at the same position in the vicinity of the inflection point C, it is desirable to set the deceleration coefficient K such that the vertical component of the upper limit value La is smaller than the limiting value 'a.' For example, FIG. 17 shows an example in which the deceleration coefficient K is set such that the vertical component of the upper limit value La is smaller than the limiting value 'a' when the distance is less than a distance R1 in the vicinity of the inflection point C (the angle coefficient Ka−0 for the sake of simplification of the description). When the deceleration coefficient K is thus set, the bucket 1*c* is further decelerated than in the ordinary area limiting control in the vicinity of the inflection point C (the range less than the distance R1 in FIG. 17), so that even in the case where there are a plurality of target surfaces, appropriate deceleration control is executed, and intrusion into the target surface of the work device can be prevented.

In the embodiment described above, when the bucket 1*c* approaches the inflection point C, the arm cylinder 3*b* is decelerated to thereby reduce the bucket speed. However, instead of/in addition to the arm cylinder 3*b*, the boom cylinder 3*a* and/or the bucket cylinder 3*c* may be decelerated.

In the case described above, in order that the work device 1A may move within the set area at the operation of the arm 1*b*, the control unit 9 serves as the start point to output an operation signal designating expansion (forcible boom raising) to the boom cylinder 3*a* to perform area limiting control. However, in the situation in which the operator serves as the start point to output an operation signal designating boom raising from the operation lever device 4*a*, the area limiting control may be performed by correcting the operation signal by the control unit 9. Further, while in the case described above area limiting control is effected by adding as appropriate boom raising by the control unit 9 at the time of arm operation by the operator operation, the area limiting control may be performed by adding as appropriate the damping/crowding of the bucket 1*c* instead of/in addition to the boom raising. That is, in the area limiting control, there is the possibility of both of the following two controls being performed such that the work device 1A may operate within the set area: a control in which the control unit 9 serves as the start point to output an operation signal to at least one of the flow control valves 5*a*, 5*b*, and 5*c* of the three hydraulic cylinders 3*a*, 3*b*, and 3*c* performing the operation of the work device 1A; and a control in which correction by the control unit 9 is effected on the operation signal output to at least one of the flow control valves 5*a*, 5*b*, and 5*c* of the three hydraulic cylinders 3*a*, 3*b*, and 3*c*, with the operator serving as the start point.

Further, the area limiting control may be executed solely at the time of arm crowding when the substantial excavating operation is executed.

In the above described case, the angle sensors 8*a* through 8*c* are utilized to gain the position and posture of the front work device 1A. Instead, it is possible to utilize a plurality of stroke sensors detecting the stroke amounts of the hydraulic cylinders 3*a* through 3*c*, or a plurality of inclination angle sensors detecting the inclination angles of the boom 1*a*, the arm 1*b*, and the bucket 1*c*.

While in the embodiment described above an ordinary hydraulic excavator driving a hydraulic pump by an engine is taken as an example, it goes without saying that the present invention is also applicable to a hybrid type hydraulic excavator driving a hydraulic pump by an engine and a motor, an electric hydraulic excavator driving a hydraulic pump by a motor alone and the like.

Further, it is also possible to adopt a structure which is equipped with a satellite communications antenna and in which global coordinates of the excavator are computed to effect area limiting control.

The present invention is not limited to the above-described embodiment but includes various modifications without departing from the scope of the gist of the invention. For example, the present invention is not limited to a structure equipped with all the components described in connection with the above embodiment. It also includes a structure in which the above components are partially deleted.

DESCRIPTION OF REFERENCE CHARACTERS

1A: Front work device
1B: Machine body
1*a*: Boom
1*b*: Arm
1*c*: Bucket

2: Hydraulic pump
3*a*: Boom cylinder (hydraulic actuator)
3*b*: Arm cylinder (hydraulic actuator)
4*a* through 4*f*, 14*a* through 14*f*: Operation lever device (operation device)
5*a* through 5*f*, 15*a* through 15*f*: Flow control valve
7: Area limiting switch
8*a* through 8*c*: Angle sensor
8*d*: Inclination angle sensor
9: Control unit
9*a*: Front posture computing section
9*b*: Area setting computing section
9*c*: Control point speed vertical component limiting value computing section
9*d*: Operator operation arm cylinder speed computing section
9*e*: Arm control point speed computing section
9*f*: Boom control point speed vertical component computing section
9*g*: Machine-control boom cylinder speed computing section
9*h*: Boom pilot pressure computing section
9*i*: Boom command computing section
9*j*: Arm pilot pressure computing section
9*k*: Arm command computing section
9*r*: Area limiting control switching computing section
9*z*: Arm cylinder target speed computing section
10*a*, 10*b*, 11*a*, 10*b*: Solenoid proportional valve
12: Shuttle valve
21: Position computing section
22: First distance computing section
23: Speed computing section
24: Projection position computing section
25: Second distance computing section
26: Determination section
27: Angle change amount computing section
28: Deceleration amount computing section
50*a* through 55*b*: Hydraulic drive section
60*a*, 60*b*, 61*a*, 61*b*: Pressure sensor
93: Storage device
900: Operation control section
910: Solenoid proportional valve control section

The invention claimed is:

1. A work machine comprising:

a multi-joint type work device formed by connecting a plurality of driven members and configured to operate in a predetermined operational plane;

a plurality of hydraulic actuators each driving corresponding one of the plurality of driven members on the basis of an operation signal;

an operation device outputting the operation signal to a hydraulic actuator desired by an operator among the plurality of hydraulic actuators; and a controller that executes area limiting control such that the work device moves on a target surface of a control object and in an area above the target surface, by outputting the operation signal to at least one hydraulic actuator among the plurality of hydraulic actuators or by outputting a corrected operation signal to said at least one hydraulic actuator, wherein the controller is configured to:

store two segments that are connected at a different angle in the operational plane and that can be the target surface of the control object, a position of an inflection point that is an intersection of the two segments in the operational plane, and a first reference point and a second reference point set at a distal end portion of the work device;

calculate positions of the first reference point and the second reference point in the operational plane on the basis of a posture of the work device, and calculate distances from the first reference point and the second reference point in the operational plane to the target surface of the control object, calculate positions in the operational plane of two projection points obtained through projection of the first reference point and the second reference point onto the target surface of the control object, and calculate the distances from the positions of the two projection points in the operational plane to the inflection point;

when a smaller one of the distances from the first reference point and the second reference point to the target surface of the control object is larger than a threshold value, output the operation signal to said at least one hydraulic actuator; and when the smaller one of the distances from the first reference point and the second reference point to the target surface of the control object is equal to or lower than a threshold value, correct the operation signal such that the operational speed of said at least one hydraulic actuator is reduced by a larger amount as a smaller one of the distances from the two projection points to the inflection point becomes smaller.

2. The work machine according to claim 1, wherein the controller is configured to:

determine whether or not the inflection point exists between the two projection points on the target surface of the control object and in the extension thereof, and when the smaller one of the distances from the first reference point and the second reference point to the target surface of the control object is equal to or lower than the threshold value, and when the controller determines that the inflection point exists between the two projection points, correct the operation signal such that the reduction degree of the operational speed of the hydraulic actuator constituting the control target of operation signal is set to a value equal to or more than a maximum value of the reduction degree set based on the smaller one of the distances from the two projection points to the inflection point.

3. The work machine according to claim 1, wherein the controller is configured to:

calculate an angle change amount which is an absolute value of a difference between a target surface angle of the target surface constituting the control object and a target surface angle of a target surface constituting a next control object, and when the controller reduces the operational speed of the hydraulic actuator constituting the control target of the operation signal, set a reduction degree of the operational speed to be larger as the angle change amount becomes larger.

* * * * *